US009039111B2

(12) United States Patent
Naitou

(10) Patent No.: US 9,039,111 B2
(45) Date of Patent: May 26, 2015

(54) SEALED DOCUMENT PREPARATION SYSTEM

(71) Applicant: Taku Naitou, Tokyo (JP)

(72) Inventor: Taku Naitou, Tokyo (JP)

(73) Assignee: RISO KAGAKU CORPORATION, Tokyo (JP)

( * ) Notice: Subject to any disclaimer, the term of this patent is extended or adjusted under 35 U.S.C. 154(b) by 201 days.

(21) Appl. No.: 13/895,777

(22) Filed: May 16, 2013

(65) Prior Publication Data

US 2013/0321549 A1 Dec. 5, 2013

(30) Foreign Application Priority Data

May 29, 2012 (JP) ..... 2012-122106

(51) Int. Cl.

| | |
|---|---|
| ***B41J 2/01*** | (2006.01) |
| ***B41J 29/00*** | (2006.01) |
| ***B41B 27/28*** | (2006.01) |
| ***B43M 5/04*** | (2006.01) |
| *B31B 1/62* | (2006.01) |
| *B31B 19/62* | (2006.01) |
| *B31B 19/88* | (2006.01) |

(52) U.S. Cl.

CPC ..... *B41B 27/28* (2013.01); *B31B 2201/88* (2013.01); *B31B 1/62* (2013.01); *B31B 19/62* (2013.01); *B31B 19/88* (2013.01); *B43M 5/045* (2013.01)

(58) Field of Classification Search

USPC ..... 347/1, 2, 171

See application file for complete search history.

(56) References Cited

U.S. PATENT DOCUMENTS 6,902,518 B2 * 6/2005 Bretl ..... 493/375
2004/0035528 A1 * 2/2004 Brignell et al. ..... 156/308.8

FOREIGN PATENT DOCUMENTS

JP 2009-274859 A 11/2009

OTHER PUBLICATIONS

Computer-generated translation of JP 2009-274859, published on Nov. 2009.*

* cited by examiner

*Primary Examiner* — Huan Tran
(74) *Attorney, Agent, or Firm* — Manabu Kanesaka

(57) ABSTRACT

There is provided a temperature detection unit 28 configured to detect an activation condition temperature that is the condition temperature causing activation of a remoistenable adhesive that is coated by water, an integrated storage unit 2 configured to store an attachment maintenance time table that is the attachment maintenance time selection condition for determining the attachment maintenance time T for the remoistenable adhesive depending on the activation condition temperature detected by the temperature detection unit 28, and an integrated control unit 3 configured to drive and control the discharge unit 26 of the enclosing and sealing apparatus 20 to thereby satisfy the attachment maintenance time T determined in response to the activation condition temperature detected by the temperature detection unit 28.

13 Claims, 6 Drawing Sheets

Fig.5

| ACTIVATION CONDITION TEMPERATURE (ENVIRONMENTAL TEMPERATURE) | ATTACHMENT MAIBTENANCE TIME(sec) |
|---|---|
| 10°C～14°C | 7.0 |
| 15°C～19°C | 4.0 |
| 20°C～24°C | 2.0 |
| 25°C～ | 1.3 |

SEALED DOCUMENT PREPARATION SYSTEM

TECHNICAL FIELD

The present invention relates to a sealed document preparation system that includes a printing unit configured to execute predetermined printing on an object to be enclosed, and an enclosing/sealing unit configured to enclose and seal the printed object to be enclosed in an envelope, and in particular, relates to a sealed document preparation system configured to execute an enclosing and sealing process that is suitable for an apparatus internal portion, or an activation condition temperature that is the peripheral temperature.

BACKGROUND ART

Conventionally, in an enclosing and sealing apparatus configured to seal and enclose a document to be sealed, a water coating process is performed in relation to a remoistenable adhesive portion after inserting the document to be sealed into an envelope that is coated with the remoistenable adhesive, and a process of attaching and enclosing the flap portion of the envelope that is configured to exhibit cohesive properties in relation to the remoistenable adhesive is executed.

Patent Document 1 below discloses a sealing apparatus configured for the purpose of improving the low-temperature transfer characteristics of an adhesive by performing an adjustment of a feeding process (feed commencement timing or feed rate) during sealing operations at a low temperature to delay the timing of separating the flap of the envelope from the transfer roller by a predetermined time, and delay the feed rate of a feed plate configured to feed the envelope during a predetermined period more than during ambient temperature.

CITATION LIST

Patent Literature

[Patent Literature 1] Japanese Patent Application Laid-Open No. 2009-274859

SUMMARY OF THE INVENTION

Technical Problem

However, the remoistenable adhesive that is transferred to the envelope exhibits temperature-dependent characteristics during the time from application of water to the expression of adhesive force, and displays a tendency for the time until activation to increase as the temperature decreases. Therefore, when the water temperature of the water that is coated onto the remoistenable adhesive portion or the environmental temperature outside of the apparatus is lower than ambient temperature (15 to 25° C.), sufficient activation of the remoistenable adhesive is not obtained, and the problem arises that sealing faults may occur during the adhesion process of the flap portion due to a weak cohesive state.

As a result, although several improvement strategies have been proposed as described below as a method for improving the activation problem in relation to the remoistenable adhesive, several problems remain in relation to each of the improvement strategies.

A first improvement is a method of heating the water coated onto the remoistenable adhesive to ambient temperature by use of a heating section such as a heater or the like. However, although the water is heated to ambient temperature by the heating section, dew condensation occurs when the internal and external temperature of the apparatus is low, and there is a risk of deterioration of the quality of the sealed document, or occurrence of corrosion on the metal components in the apparatus due to attachment of water drops to the path in the apparatus or to a position other than the remoistenable adhesive portion in the envelope.

A second improvement is a method of enhancing the properties of the remoistenable adhesive to enable activation in a short time even at a low temperature. However, when the performance of the remoistenable adhesive is improved, for example, the envelope prior to printing is placed in a feed tray of the printing apparatus. During that period, the adhesive can be easily activated, and as a result, the problem arises that blocking occurs in relation to the sheets of the envelope.

A third improvement is a method of increasing the length of the discharge path in relation to the configuration of the apparatus. However, the problem arises that the installation space becomes limited due to an increase in the size of the apparatus, or the apparatus price increases as a result of the increase in size.

The sealing apparatus in Patent Document 1 is an apparatus that is configured to improve a deterioration in the transfer characteristics at a low temperature of the adhesive that is transferred onto the flap portion of the envelope, and therefore, the apparatus configuration is different from a sealing apparatus that executes a sealing process by performance of a water coating process onto a remoistenable adhesive that is the object of the present invention. However, the timing control of the transfer operation disclosed in Patent Document 1 is assumed to have been adopted as a technique for execution of a water coating process that is longer than usual onto the remoistenable adhesive transferred onto the envelope.

However even when the water coating process is executed in accordance with the transfer operation timing in Patent Document 1, since the processing time at a low temperature is increased in comparison to the processing time at ambient temperature, the intended activation of the remoistenable adhesive causes the problem of a reduction in productivity.

The present invention is proposed in light of the above problems, and has the object of providing a sealed document preparation system that enables execution of a sealing process with high reliability corresponding to temperature conditions causing activation of a remoistenable adhesive and not resulting in a reduction in productivity.

Solution to Problem

In order to achieve the above purpose, the sealed document preparation system according to claim 1 includes:

a printing apparatus that has a printing unit that is configured to perform a desired printing process during conveying of envelope paper that is the sealed document and of printing paper that is the document to be enclosed, an enclosing and sealing apparatus that includes an enclosing and sealing unit configured to enclose the document to be enclosed in an envelope formed by folding of envelope paper input from the printing apparatus, and perform sealing after executing a water coating process onto the remoistenable adhesive on the envelope, and a discharge unit configured to grip both surfaces of the sealed document with a predetermined pressure and convey and discharge the sealed document that is prepared in the enclosing and sealing unit, a temperature detection unit configured to detect an activation condition temperature that is the condition temperature causing activation of the remoistenable adhesive that is coated with water, an integrated storage unit configured to store an attachment maintenance time selection condition for determining the attachment maintenance time of the remoistenable adhesive in accordance with the activation condition temperature that is detected by the temperature detection unit, and an integrated control unit configured to drive and control the discharge unit to satisfy the attachment maintenance time determined corresponding to the activation condition temperature detected by the temperature detection unit.

The sealed document preparation system according to claim 2 is such that the integrated storage unit in the sealed document preparation system according to claim 1 stores printing conditions in relation to the printing apparatus and enclosing and sealing conditions in relation to the enclosing and sealing apparatus. The integrated control unit calculates a discharge conveying time for the sealed document in the discharge unit based on the printing conditions and the enclosing and sealing conditions, and when the discharge conveying time is less than the attachment maintenance time determined from the activation condition temperature, the discharge unit is intermittently driven and controlled to drive at a preset discharge unit conveying rate.

The sealed document preparation system according to claim 3 is such that the integrated storage unit in the sealed document preparation system according to claim 2 further stores a sealed document preparation condition for the sealed document to be prepared, and the integrated control unit calculates a discharge unit intermittent stop allowable time and a discharge unit intermittent stop time for the discharge unit based on the sealed document preparation condition, the printing condition and the enclosing and sealing condition, and when the discharge unit intermittent stop allowable time is less than the discharge intermittent stop time, control is performed to suitably adjust the printing conditions of the printing apparatus.

The sealed document preparation system according to claim 4 is such that the integrated storage unit of the sealed document preparation system according to claim 1 stores a sealed document preparation condition for a sealed document to be prepared, printing conditions for the printing apparatus, and an enclosing/sealing condition for the enclosing and sealing apparatus, and the integrated control unit drives and controls the discharge unit at a discharge conveying rate that is calculated from an attachment maintenance time T that corresponds to the activation condition temperature detected by the temperature detection unit, and the enclosing/sealing condition, and calculates a sealed document gap in the discharge unit based on the sealed document preparation condition, the printing condition and the enclosing/sealing condition. When the sealed document gap is less than a preset minimum allowable gap value, the printing condition for the printing apparatus is suitably adjusted and controlled.

The sealed document preparation system according to claim 5 is such that the sealed document preparation condition in the sealed document preparation system according to claim 3 includes an enclosed document conveying direction length $L_2$, an envelope paper conveying direction length $L_3$, a sealed document conveying direction length $L_4$, and an enclosed document sheet number N. The printing condition includes a paper gap $G_1$, a print set basic gap $G_2$, and a printing unit conveying rate $V_1$.

The enclosing/sealing conditions include a discharge unit sealed document minimum allowable gap $G_3$, an enclosing and sealing unit conveying rate $V_2$, a discharge unit conveying length $L_1$, and a discharge unit conveying rate $V_3$. The attachment maintenance time selection condition is configured as an attachment maintenance time table that associates the activation condition temperature detected by the temperature detection unit with the attachment maintenance time T that is required for the remoistenable adhesive specified for each activation condition temperature.

The integrated control unit calculates a discharge conveying time based on the discharge unit conveying length $L_1$ and the sealed document conveying direction length $L_4$, and selects the attachment maintenance time T corresponding to the activation condition temperature by making reference to the activation condition temperature detected by the temperature detection unit and the attachment maintenance time table stored in the integrated storage unit. When the calculated discharge conveying time is less than the attachment maintenance time T, the discharge unit that drives at a discharge unit conveying rate $V_3$ is driven and controlled intermittently.

The sealed document preparation system according to claim 6 is such that the integrated control unit in the sealed document preparation system according to claim 5 further uses the sealed document preparation condition, the printing condition, and the enclosing/sealing condition to calculate a discharge unit intermittent stop time $T_3$ that is the stop time during intermittent driving in the discharge unit required to satisfy the attachment maintenance time T, and a discharge unit intermittent stop allowable time $T_4$ that is the stop time that is allowable during intermittent driving.

When the discharge unit intermittent stop allowable time $T_4$ is less than the discharge unit intermittent stop time $T_3$, a print set gap adjustment value $G_2'$ that is the gap adjustment value between print sets in the printing unit is calculated based on the sealed document preparation condition, the printing condition, and the enclosing/sealing condition, and the printing unit is driven and controlled to coincide with a print set gap that is obtained by adding the print set gap adjustment value $G_2'$ to the print set basic gap $G_2$.

The sealed document preparation system according to claim 7 is such that the integrated control unit in the sealed document preparation system according to claim 6 includes:

an attachment maintenance time selection unit that refers to the activation condition temperature detected by the temperature detection unit and the attachment maintenance time table that is stored in the integrated storage unit to select and output an attachment maintenance time T corresponding to the currently detected activation condition temperature, a discharge conveying time calculation section configured to calculate the discharge conveying time $T_2$ based on the discharge unit conveying length $L_1$, the sealed document conveying direction length $L_4$, and the discharge unit conveying rate $V_3$ that are stored in the integrated storage unit, a discharge unit retaining/passing number calculation section configured to use the discharge unit conveying length $L_1$, the enclosed document conveying direction length $L_2$, the envelope paper conveying direction length $L_3$, the sealed document conveying direction length $L_4$, the enclosed document sheet number N, the print set basic gap $G_2$, the printing unit conveying rate $V_1$, the enclosing and sealing unit conveying rate $V_2$, and the discharge unit conveying rate $V_3$ to calculate an allowable capacity-passing number minimum stop time $T_5$ and an allowable capacity-passing number stop time $T_6$ in the discharge unit, and acquire the retaining/passing number of the sealed document in the discharge unit as the discharge unit retaining/passing number m with reference to the dimensional relationship of the allowable capacity-passing number minimum stop time $T_5$ and the allowable capacity-passing number stop time $T_6$, a discharge unit intermittent stop time calculation section configured to use the attachment maintenance time T selected by the attachment maintenance time selection unit, the discharge conveying time $T_2$ calculated by the discharge conveying time calculation unit, and the discharge unit retaining/passing number m calculated by the discharge unit retaining/passing number calculation section to calculate the discharge unit intermittent stop time $T_3$, a discharge unit intermittent stop allowable time calculation section configured to use the discharge unit conveying length $L_1$, the enclosed document conveying direction length $L_2$, the envelope paper conveying direction length $L_3$, and the sealed document conveying direction length $L_4$, the enclosed document sheet number N, the print set basic gap $G_2$, the printing unit conveying rate $V_1$, the enclosing and sealing unit conveying rate $V_2$, and the discharge unit conveying rate $V_3$ that are stored in the integrated storage unit to calculate the discharge unit intermittent stop allowable time $T_4$, a print set gap adjustment value calculation section configured to use the printing unit conveying rate $V_1$ and the enclosing and sealing unit conveying rate $V_2$ that are stored in the integrated storage unit, the discharge unit intermittent stop time $T_3$ that is calculated by the discharge unit intermittent stop time calculation section and the discharge unit intermittent stop allowable time $T_4$ that is calculated by the discharge unit intermittent stop allowable time calculation section to calculate the print set gap adjustment value $G_2'$, a comparison processing unit configured to compare the dimensional relationship between the discharge unit intermittent stop time $T_3$ that is calculated by the discharge unit intermittent stop time calculation section and the discharge unit intermittent stop allowable time $T_4$ that is calculated by the discharge unit intermittent stop allowable time calculation section, and when the discharge unit intermittent stop allowable time $T_4$ is less than discharge unit intermittent stop time $T_3$, to output gap adjustment control information to control the print set gap in the printing unit with a print set gap execution value $G_5$ that is obtained by adding the print set gap adjustment value $G_2'$ calculated by the print set gap adjustment value calculation section to the print set basic gap $G_2$, a discharge control unit configured to intermittently drive and control the discharge unit in accordance with the discharge unit intermittent stop time $T_3$ that is calculated by the discharge unit intermittent stop time calculation section, and a printing-side control unit that is configured to adjust and control the driving of the printing unit to coincide with the print set gap according to the gap adjustment control information from the comparison processing unit.

The sealed document preparation system according to claim 8 is such that the comparison processing unit in the sealed document preparation system according to claim 7 outputs the comparison result of the dimensional comparison of the allowable capacity-passing number minimum stop time $T_5$ and the allowable capacity-passing number stop time $T_6$ to the discharge unit retaining/passing number calculation section.

The sealed document preparation system according to claim 9 is such that the comparison processing unit in the sealed document preparation system according to claim 8 outputs an adjustment value calculation instruction for the calculation of the print set gap adjustment value $G_2'$ to the print set gap adjustment value calculation section, when the discharge unit intermittent stop allowable time $T_4$ is less than the discharge unit intermittent stop time $T_3$.

The sealed document preparation system according to claim 10 is such that the sealed document preparation condition in the sealed document preparation system according to claim 4 includes the enclosed document conveying direction length $L_2$, the envelope paper conveying direction length $L_3$, the sealed document conveying direction length $L_4$, and the enclosed document sheet number N. The printing condition includes the paper gap $G_1$, the print set basic gap $G_2$, and the printing unit conveying rate $V_1$.

The enclosing/sealing conditions include the discharge unit sealed document minimum allowable gap $G_3$, the enclosing and sealing unit conveying rate $V_2$, and the discharge unit conveying length $L_1$. The attachment maintenance time selection condition is configured as an attachment maintenance time table that associates the activation condition temperature detected by the temperature detection unit with the attachment maintenance time T that is required for the remoistenable adhesive specified for each activation condition temperature.

The integrated control unit drives and controls the discharge unit using the discharge unit conveying rate that is calculated using the activation condition temperature detected by the temperature detection unit, and attachment maintenance time that is selected by reference to the attachment maintenance table stored in the integrated storage unit, and the discharge unit conveying length $L_1$.

The sealed document preparation system according to claim 11 is such that the integrated control unit in the sealed document preparation system according to claim 10 further uses the sealed document preparation condition, the printing condition, and the enclosing/sealing condition to calculate a discharge unit sealed document gap $G_4$ that is a gap between the sealed documents in the discharge unit, when the discharge unit sealed document gap $G_4$ is less than the discharge unit sealed document minimum allowable gap $G_3$, the print set gap adjustment value $G_2'$ that is the print set gap adjustment value in the printing unit is calculated using the sealed document preparation condition, the printing condition, and the enclosing/sealing condition, and the printing unit is driven and controlled to coincide with the print set gap that is obtained by adding the print set gap adjustment value $G_2'$ to the print set basic gap $G_2$.

The sealed document preparation system according to claim 12 is such that the integrated control unit in the sealed document preparation system according to claim 11 includes:

a discharge rate calculation unit configured to use the attachment maintenance time T corresponding to the activation condition temperature detected by the temperature detection unit and the discharge unit conveying length $L_1$ stored in the integrated storage unit to calculate and output the discharge unit conveying rate $V_3$, an envelope paper pitch calculation section configured to use the enclosed document conveying direction length $L_2$, the envelope paper conveying direction length $L_3$, the enclosed document sheet number N, the paper gap $G_1$, and the print set basic gap $G_2$ that are stored in the integrated storage unit to calculate an envelope paper pitch $P_1$, an sealed document pitch calculation section configured to use the printing unit conveying rate $V_1$ and the enclosing and sealing unit conveying rate $V_2$ stored in the integrated storage unit, and the envelope paper pitch $P_1$ calculated by the envelope paper pitch calculation section to calculate a sealed document pitch $P_2$, a discharge unit sealed document pitch calculation section configured to use the enclosing and sealing unit conveying rate $V_2$ stored in the integrated storage unit, the discharge unit conveying rate $V_3$ calculated by the discharge rate calculation unit, and the sealed document pitch $P_2$ from the sealed document pitch calculation section to calculate a discharge unit sealed document pitch $P_3$, a discharge unit sealed document gap calculation section configured to use the discharge unit sealed document pitch $P_3$ from the discharge unit sealed document pitch calculation section and the sealed document conveying direction length $L_4$ stored in the integrated storage unit to calculate the discharge unit sealed document gap $G_4$, a print set gap adjustment value section configured to use the enclosing and sealing unit conveying rate $V_2$ and the discharge unit sealed document minimum allowable gap $G_3$ stored in the integrated storage unit, the discharge unit conveying rate $V_3$ calculated by the discharge rate calculation unit, and the discharge unit sealed document gap $G_4$ from the discharge unit sealed document gap calculation section to calculate the print set gap adjustment value $G_2'$, a comparison processing unit configured to compare the dimensional relationship between the discharge unit sealed document gap $G_4$ from the discharge unit sealed document gap calculation section and the discharge unit sealed document minimum allowable gap $G_3$ stored in the integrated storage unit, and when the discharge unit sealed document gap $G_4$ is less than the discharge unit sealed document minimum allowable gap $G_3$, output gap adjustment control information to control the print set gap in the printing unit using the print set gap execution value $G_5$ obtained by adding the print set gap adjustment value $G_2'$ from the print set gap adjustment value calculation section to the print set basic gap $G_2$, a discharge control unit configured to drive and control the discharge unit at a conveying rate according to the discharge unit conveying rate $V_3$ calculated by the discharge rate calculation unit, and a printing-side control unit configured to adjust and control the driving of the printing unit to coincide with the print set gap according to the gap adjustment control information from the comparison processing unit.

The sealed document preparation system according to claim 13 is such that the comparison processing unit in the sealed document preparation system according to claim 12, when the discharge unit sealed document gap $G_4$ is less than the discharge unit sealed document minimum allowable gap $G_3$, is configured to output an adjustment value calculation instruction to calculate the print set gap adjustment value $G_2'$ to the print set gap adjustment value calculation section.

Advantageous Effects of Invention

According to the sealed document preparation system as recited in claim 1, sealing and attachment can be ensured by placing the remoistenable adhesive in the discharge unit in an activated state without affecting the activation temperature by suitable driving and control of the discharge unit in response to the detected activation condition temperature.

According to the sealed document preparation system as recited in claim 2, sealing failure can be prevented and supplementary sealing processing can be performed that is adapted to the sealed document after sealing by the discharge process of the sealed document prepared by simplified control since the discharge unit is intermittently driven to satisfy the attachment maintenance time T corresponding to the detected activation condition temperature.

According to the sealed document preparation system as recited in claims 3, 5 to 8, sealing failure can be prevented and supplementary sealing processing can be performed that is adapted to the sealed document after sealing by the discharge process of the prepared sealed document since, when the discharge unit is driven intermittently, the print set gap is adjusted and controlled in the printing unit as required.

According to the sealed document preparation system as recited in claim 9, the processing load on the integrated control unit prior to commencement of printing can be reduced since the print set gap adjustment value $G_2'$ is calculated only when the discharge unit intermittent stop allowable time $T_4$ is less than the discharge unit intermittent stop time $T_3$, and the driving of the printing unit is adjusted and controlled so that the print set gap of the printing unit coincides with a gap that is obtained by adding the print set gap adjustment value $G_2'$ to the print set basic gap $G_2$.

According to the sealed document preparation system as recited in claims 4, and 10 to 12, sealing failure can be prevented and supplementary sealing processing can be performed that is adapted to the sealed document after sealing by the discharge process of the prepared sealed document and any reduction in productivity can be reduced to a minimum by adjusting and controlling the print set gap in the printing unit as required so that the discharge rate of the discharge unit is varied in response to the detected activation condition temperature, and the sealed document gap in the discharge unit is greater than or equal to the discharge unit sealed document minimum allowable gap $G_3$.

According to the sealed document preparation system as recited in claim 13, the processing load on the integrated control unit prior to commencement of printing can be reduced since the print set gap adjustment value $G_2'$ is calculated only when the discharge unit sealed document gap $G_4$ is less than the discharge unit sealed document minimum allowable gap $G_3$, and the driving of the printing unit is adjusted and controlled so that the print set gap of the printing unit coincides with a gap that is obtained by adding the print set gap adjustment value $G_2'$ to the print set basic gap $G_2$.

BRIEF DESCRIPTION OF DRAWING

[FIG. 5] illustrates an example of an attachment maintenance time table in the present embodiment.

DESCRIPTION OF EMBODIMENTS

The embodiments for executing the present invention will be described in detail below making reference to the attached figures. Furthermore, the aspects of the embodiments place no limitation on the invention, and other embodiments that can be executed by a person of ordinary skill in the art based on the embodiments, in addition to the examples and operating techniques are all included in the scope of the present invention.

The present invention is a system for performance of desired sealed document preparation that is configured by a forward-stage printing apparatus that is configured to perform a desired printing process in relation to an enclosed document or envelope paper, and a rear-stage enclosing and sealing apparatus that is configured to enclose an enclosed document in an envelope after folding of envelope paper and an enclosed document on which printing has been performed, and to execute a sealing operation by executing a water coating process onto a remoistenable adhesive that is pre-transferred onto a predetermined position of the envelope, and attach the flap portion in an activated state.

Although the following description describes an example of an inkjet recording apparatus as an image forming apparatus forming a printing unit that is configured to print on the envelope paper and the enclosed document, various types of image forming apparatuses may be used such as a stencil printing apparatus, a copying machine, a laser printer, or the like.

Although an example of an "activation condition temperature" that is the condition temperature when defining the attachment maintenance time for the sealed document in the discharge unit is described in the present embodiment with reference to the environmental temperature in the apparatus detected by the temperature detection unit, the activation condition temperature may be various types of temperature inside or outside of the apparatus that result in the activation of the remoistenable adhesive coated with water such as the environmental temperature outside of the apparatus, the water temperature of the water coated onto the remoistenable adhesive, or the like. When the environmental temperature outside of the apparatus is detected as the activation condition temperature, provision is possible in either the printing apparatus or the enclosing and sealing apparatus.

Overview of System

Firstly, the general configuration of the enclosing and sealing system 1 according to the present invention will be described. The enclosing and sealing system 1 according to the present example is configured from a printing apparatus 10 and an enclosing and sealing apparatus 20.

<Printing Apparatus>

Figure 1:
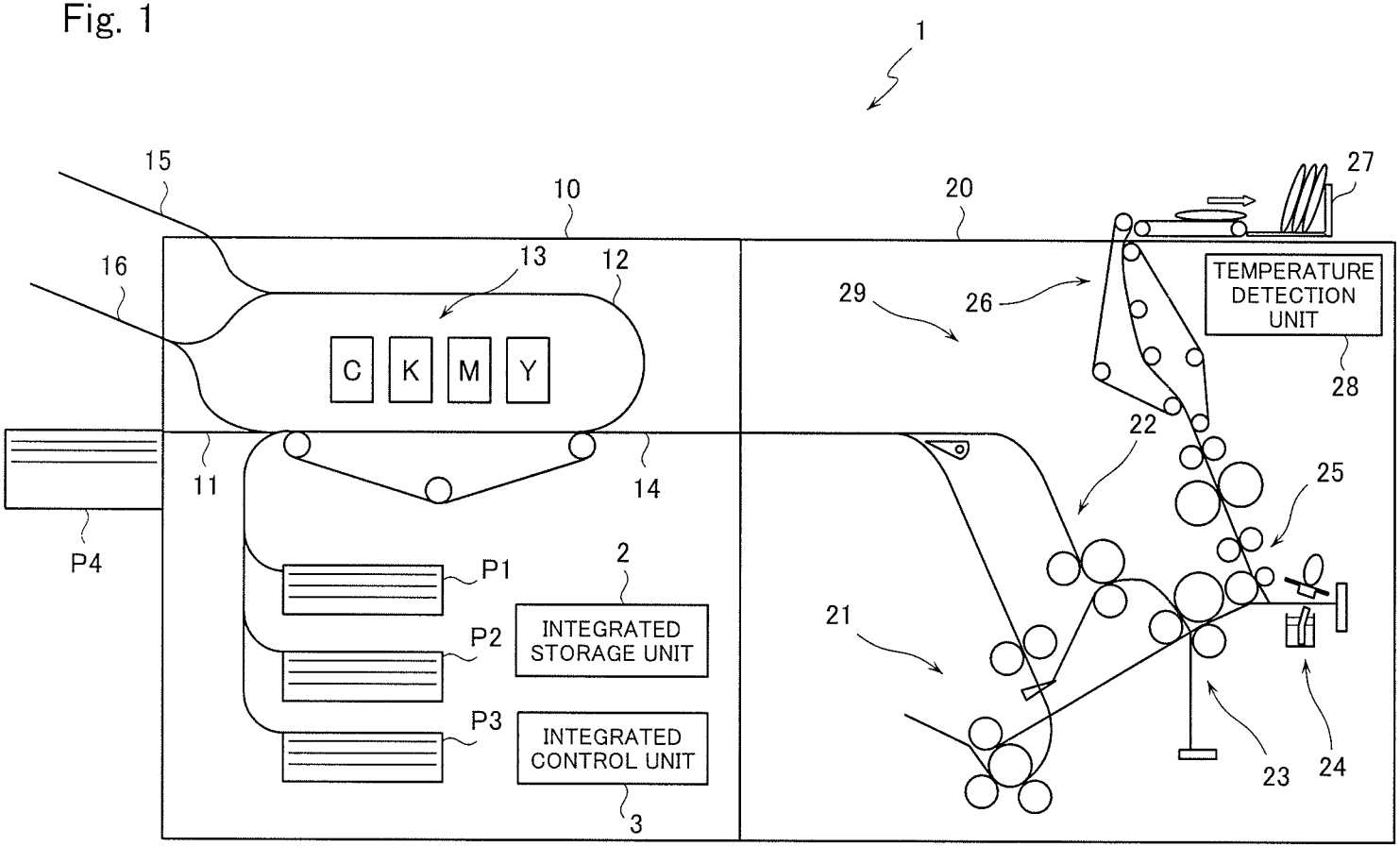
[FIG. 1] is a schematic figure illustrating the overall configuration of a sealed document preparation system according to the present invention.

As illustrated in FIG. 1, the printing apparatus 10 is an apparatus that is configured to print and discharge an envelope and a sheet of paper that is an object to be enclosed, and includes a plurality of paper feed trays ($P_1$ to P4) that enables storage of a plurality of types of paper sheets (envelope paper or leaf sheets being the object to be enclosed) in a side surface or inner portion of a housing that accommodates various units, a conveyance path 12 in a loop configuration for conveying paper from a guide path 11, a printing unit 13 configured to execute desired printing using a printing section configured from four inkjet heads C, K, M, Y that respectively eject ink of various colors being cyan (C), black (K), magenta (M) and yellow (Y) while various types of sheets forming the object to be printed are conveyed by a predetermined conveyance section, a first discharge path 14 configured to discharge the sheet of paper to the enclosing and sealing apparatus 20, a second discharge path 15 configured to discharge the sheet of paper out of the loop, and a switch back path 16 configured to receive the sheet of paper conveyed through the conveyance path 12, and reverse the direction of conveyance to thereby return the sheet to the conveyance path 12 and invert the vertical dimensions of the sheet of paper.

<Enclosing and Sealing Apparatus>

As illustrated in FIG. 1, the enclosing and sealing apparatus 20 includes an enclosed document folding unit 21 configured to execute a predetermined folding process as required while conveying a sheet of paper being the enclosed document, an envelope paper folding unit 22 configured to execute a predetermined folding process while conveying an envelope paper being the envelope, a enclosing unit 23 configured to seal so that the enclosed document is enclosed in the envelope paper during conveying, a water coating process unit 24 configured to coat water onto a pre-transferred remoistenable portion of the envelope that encloses the enclosed document, a sealing unit 25 configured to seal the envelope after water coating during conveying, a discharge unit 26 configured to discharge the sealed document that has been subject to sealing processing to a discharge plate 27, and a temperature detection unit 28 configured by a known temperature detecting sensor such as a thermistor or the like to detect an activation condition temperature during execution of a sealed document preparation job. In the present embodiment, the enclosing and sealing unit 29 functions to perform preparation of a sealed document by executing predetermined processing operations on the paper subjected to printing that forms the enclosed document and the envelope paper in sequence by use of the enclosed document folding unit 21, or the envelope paper folding unit 22, the enclosing unit 23, the water coating processing unit 24, and the sealing unit 25.

The configuration of the discharge unit 26 as illustrated in FIG. 1 opposes two endless conveyance belts that are looped on a plurality of conveyance rollers relative to the whole conveyance region. The discharge unit 26 performs an accurate sealing process in relation to the sealed document by execution of a so-called "supplementary sealing process" for a supplementary sealing process in addition to the sealing process executed by the sealing unit 25 and for discharging and conveying while gripping both surfaces of the sealed document that is conveyed from the sealing unit 25 with a predetermined pressure from the respective conveyance belts.

In the sealed document preparation system 1, when a user sets a sealed document preparation job, and a printing process is executed by the printing unit 10 on the sheet number of an enclosed document that is specified in the job details, and a single sheet of envelope paper, and conveyed to the enclosing and sealing apparatus 20 at a fixed interval in relation to respective sets that configure the sealed document. The enclosing and sealing apparatus 20 causes execution of a predetermined folding process by the enclosed document folding unit 21 during input on the same path or a different path, and conveying on respectively different conveyance paths, and executes a folding process as required to form the envelope in the envelope paper folding unit 22. Furthermore, the flow of both the above finally coincides in the enclosing unit 23, the enclosed document is enclosed by wrapping in the envelope paper, and water is coated on the remoistenable adhesive that is transferred onto a predetermined position of the envelope paper by the water coating process unit 24 to thereby perform activation. Thereafter, the flap portion of the envelope is attached to the remoistenable adhesive portion that has been activated by the sealing unit 25, and after a sealing process, the sealed document that has been prepared is discharged from the discharge unit 26 to the discharge plate 27.

The sealed document preparation system 1 includes an integrated storage unit 2 configured to store drive control information for each unit that configures the printing apparatus 10 and the enclosing and sealing apparatus 20, and an integrated control unit 3 configured to drive and control each unit that configures the printing apparatus 10 and the enclosing and sealing apparatus 20.

System Configuration

Next, the system configuration of the sealed document preparation system 1 according to the present example will be described.

The sealed document preparation system 1 in the present example has a system configuration to prevent sealing failure in relation to a prepared sealed document, and includes a configuration (first configuration) in which the conveying timing or the like of the printing unit 13 in the printing apparatus 10 is adjusted and controlled, or control is performed to intermittently drive the discharge unit 26 in the enclosing and sealing apparatus 20 corresponding to a detected activation condition temperature, and a configuration (second configuration) in which the conveying rate of the discharge unit 26 in the enclosing and sealing apparatus 20 or the conveying rate or the conveying timing of the printing unit 13 in the printing apparatus 10 is adjusted and controlled corresponding to the detected activation condition temperature.

The normal driving and control details in the printing apparatus 10 and the enclosing and sealing apparatus 20 that configure the sealed document preparation system 1 in the following description (for example, the drive and control related to the printing processing in the printing apparatus 10, the driving and control related to the double-sided printing processing, the driving and control related to the folding processing in the enclosing and sealing apparatus 20, and the driving and control related to the water coating processing unit 24, or the like) are known techniques, and therefore such description will be omitted, and only the processing and operation and the system configuration that characterizes each configuration will be described.

In each configuration, the paper length (long side) along the conveying direction of the printing paper that is the enclosed document and the envelope paper that is the printing object is defined as the "conveying direction length", and the paper length that is orthogonal to the conveying direction length of the prepared enclosed document (short side) is defined as the "sealed document conveying direction length".

<First Embodiment of System Configuration>

Figure 2:
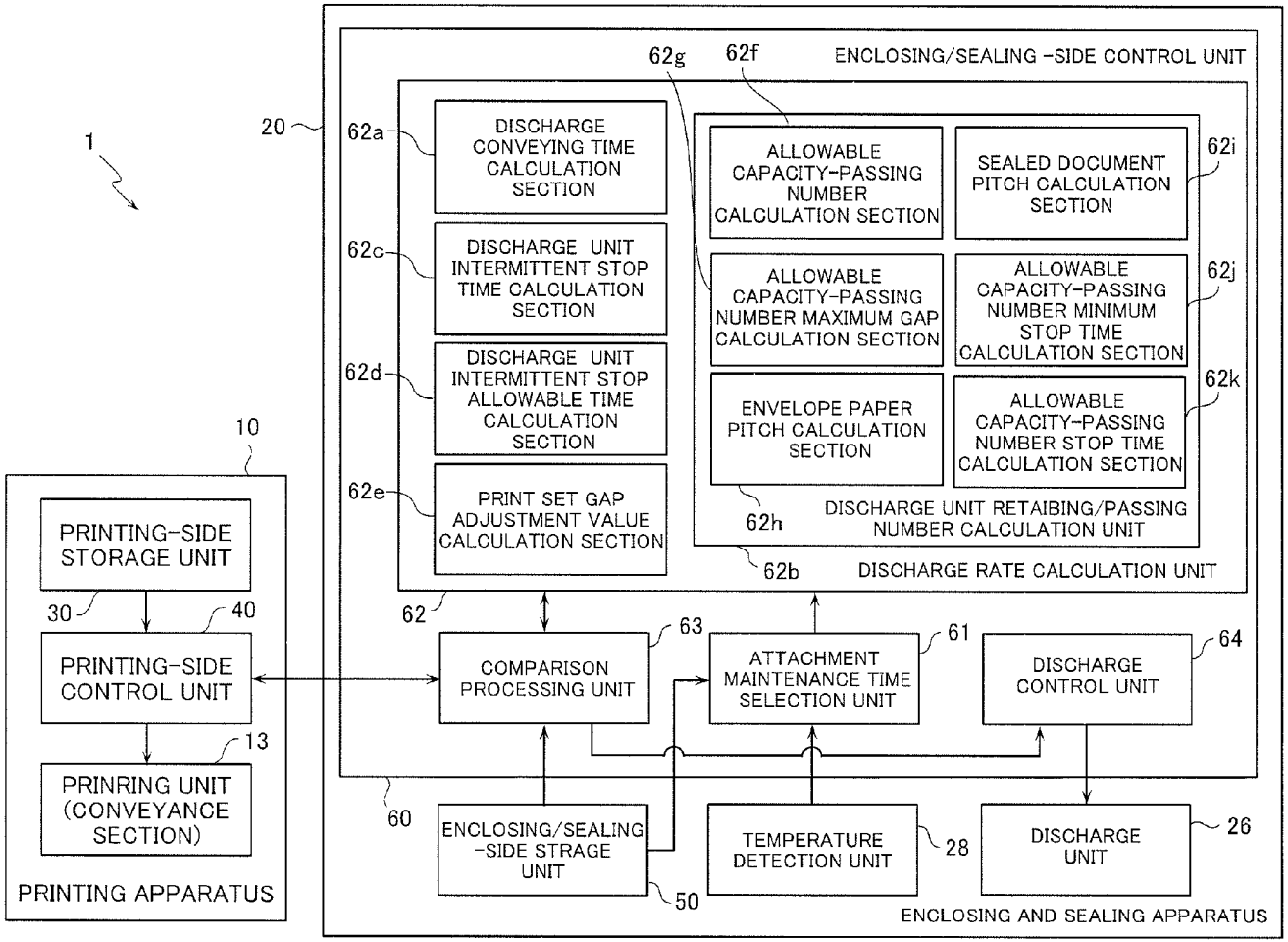
[FIG. 2] is a functional block diagram illustrating the system configuration according to a first embodiment of the apparatus.

In FIG. 2, a system configuration will be described in which the printing apparatus 10 and the enclosing and sealing apparatus 20 respectively include a function of a control unit and a storage unit in order to clarify the function of the integrated storage unit 2 and the integrated control unit 3 in the sealed document preparation system according to the first configuration. That is to say, a system configuration that drives and controls the printing apparatus 10 includes a printing-side storage unit 30 configured to store driving and control information or the like that is required for performance of driving and control of each unit that configures the printing apparatus 10, and a printing-side control unit 40 for performance of driving and control of each unit that configures the printing apparatus 10. Furthermore, a system configuration that drives and controls the enclosing and sealing apparatus 20 includes an enclosing/sealing-side storage unit 50 configured to store various types of driving and control information or the like that is required for performance of driving and control of each unit that configures the enclosing and sealing apparatus 20, and an enclosing/sealing-side control unit 60 configured to perform driving and control of each unit that configures the enclosing and sealing apparatus 20.

(System Configuration of Printing Apparatus)

As illustrated in FIG. 2, a system configuration of the printing apparatus 10 includes the printing-side storage unit 30 and the printing-side control unit 40.

In addition to drive and control information for each unit that configures the printing apparatus 10, the printing-side storage unit 30 stores sealed document preparation job information that is set arbitrarily by a use and printing apparatus basic information that is unique information for the printing apparatus 10.

Figure 3:
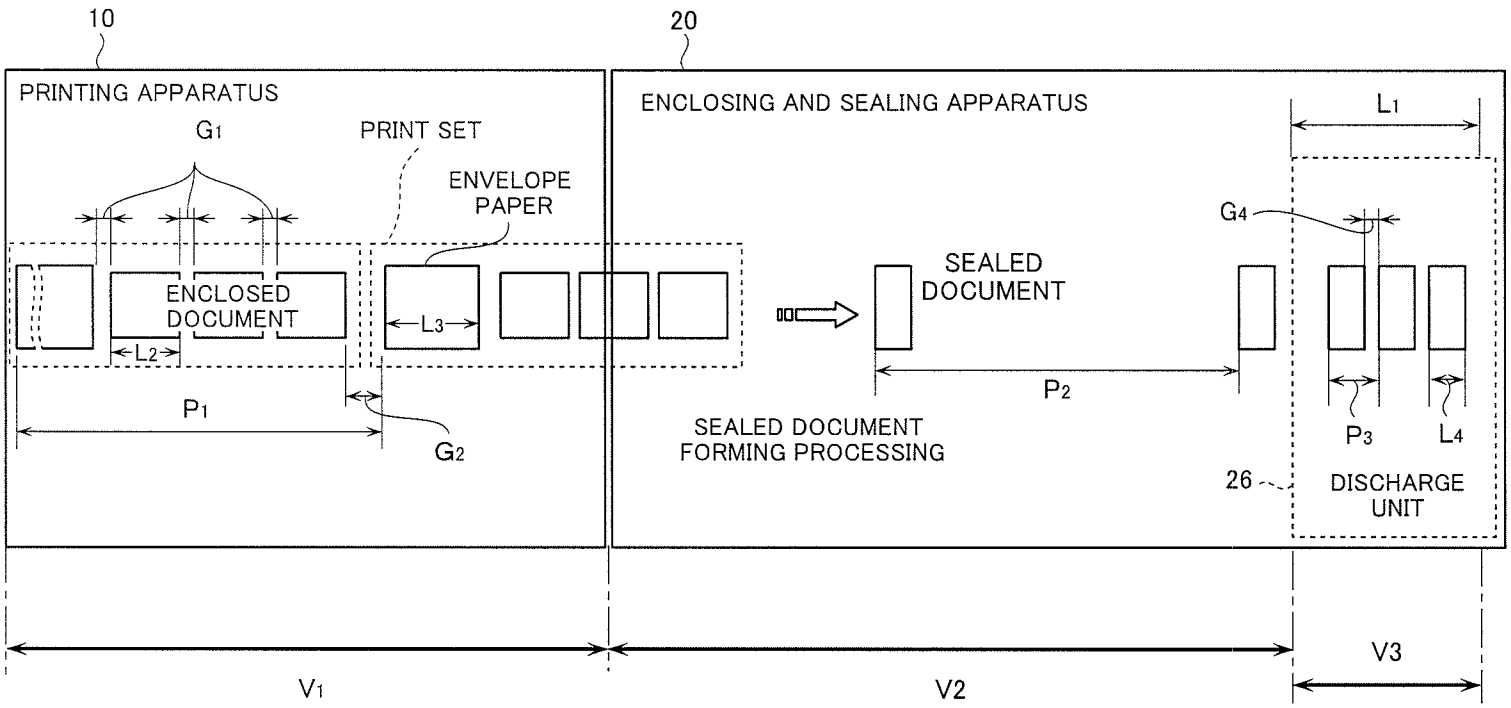
[FIG. 3] illustrates the flow of a sealed document preparation process of a print set configured from one sheet of envelope paper and three sheets of an enclosed document as one set in relation to the apparatus.
Figure 4:
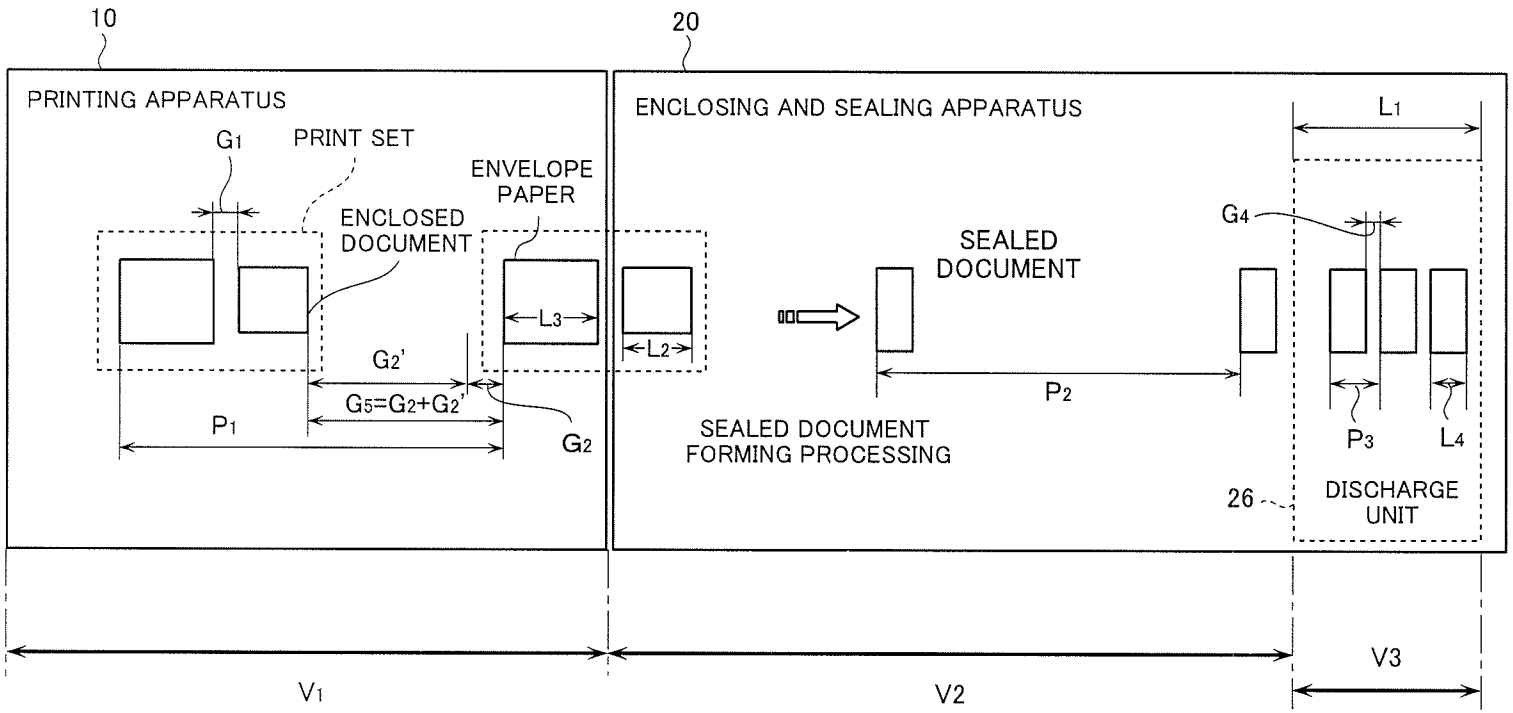
[FIG. 4] illustrates the flow of a sealed document preparation process of a print set configured from one sheet of envelope paper and one sheet of an enclosed document as one set in relation to the apparatus.

As illustrated in FIG. 3 and FIG. 4, the printing apparatus basic information includes a printing unit conveying rate $V_1$ that indicates the conveying rate of printed materials in the printing unit 13, a paper gap $G_1$ that indicates a gap between respective enclosed documents, and a print set basic gap $G_2$ that indicates the gap between the respective sets in which one set is a predetermined number of enclosed documents and envelope papers that configure a sealed document in the enclosing and sealing apparatus 20, and are the printing conditions that are unique to an apparatus as defined corresponding to the apparatus specification of the printing apparatus 10. The printing apparatus basic information is suitably set corresponding to the apparatus specification.

As illustrated in FIG. 3 or FIG. 4, the sealed document preparation job information includes an enclosed document conveying direction length $L_2$ that indicates the conveying direction length of printing paper that is the enclosed document, an envelope paper conveying direction length $L_3$ that indicates the conveying direction length of the printed envelope paper, the enclosed document sheet number N that indicates the enclosed sheet number of enclosed documents, and the sealed document conveying direction length $L_4$ that indicates the conveying direction length of the sealed document after preparation, and are the sealed document preparation conditions that are unique to a job as defined corresponding to the preparation details or the prepared copy number of prepared sealed documents.

When the sealed document preparation job information is set in an arbitrary manner by a user, the printing-side control unit 40 executes printing processing control to perform predetermined printing processing on the printing paper and the envelope paper in accordance with the job information.

When the basic driving and control information is input from the enclosing/sealing-side control unit 60, the printing-side control unit 40 executes predetermined printing processing control in accordance with the printing apparatus basic information stored in the printing-side storage unit 30.

Furthermore, when gap control information (normal gap control information, gap adjustment control information) is input from the enclosing/sealing-side control unit 60, the printing-side control unit 40 adjusts and controls the paper conveying timing and the conveying rate of the printing unit 13 to coincide with a print set gap in accordance with the information.

As illustrated in FIG. 3, the gap control between print sets is configured by adjusting and controlling the printing unit 13 so that the print set gap coincides with the print set basic gap $G_2$ in accordance with normal gap control information from a comparison processing unit 63, and thereafter print processing is performed, when adjustment of the print set gap is not required during sealed document preparation using, for example, one sheet of envelope paper and three sheets of printing paper forming the enclosed document.

As illustrated in FIG. 4, the printing unit 13 is controlled and adjusted to configure a gap amount for the print set gap that is obtained by adding the print set gap adjustment value $G_2'$ to the preset print set basic gap $G_2$ in accordance with gap adjustment and control information from the comparison processing unit 63 when adjustment of the print set gap is required during sealed document preparation using for example one sheet of envelope paper and one sheet of printing paper forming the enclosed document, and thereafter print processing is performed.

(Configuration of System for Enclosing and Sealing Apparatus)

As illustrated in FIG. 2, the system configuration of the enclosing and sealing apparatus 20 is configured from the enclosing/sealing-side storage unit 50 and the enclosing/sealing-side control unit 60.

In addition to drive control information for respective units that configure the enclosing and sealing apparatus 20, the enclosing/sealing-side storage unit 50 stores enclosing and sealing apparatus basic information that is unique information for the enclosing and sealing apparatus 20, and an attachment maintenance time table that associates the attachment maintenance time T that is adapted to the discharge unit 26 corresponding to the detected activation condition temperature.

As illustrated in FIG. 3 and FIG. 4, the enclosing and sealing apparatus basic information includes the enclosing and sealing unit conveying rate $V_2$ that indicates the conveying rate of each unit in the enclosing and sealing unit 29, a discharge unit conveying rate $V_3$ that indicates the conveying rate of the sealed document in the discharge unit 26, a discharge unit sealed document minimum allowable gap $G_3$ indicating the allowable value for the minimum allowable gap between prepared sealed documents, and a discharge unit conveying length $L_1$ that indicates the overall conveying length in the discharge unit 26, and are the enclosing and sealing conditions unique to the apparatus that are specified corresponding to the apparatus specification for the enclosing and sealing apparatus 20. The enclosing and sealing apparatus basic information is suitably set corresponding to the apparatus specification.

The attachment maintenance time table is information configured as a table that associates the activation condition temperature detected by the temperature detection unit 28 with the attachment maintenance time T that is required for the remoistenable adhesive specified for each activation condition temperature, and shows the conditions (attachment maintenance time selection conditions) for driving and controlling the discharge unit 26 during an attachment maintenance time T that is suitable for the detected activation condition temperature.

FIG. 5 illustrates an example of a table configured using an environmental temperature in an apparatus that configures the activation condition temperature, and an attachment maintenance temperature T adapted to the environmental temperature, when using a certain remoistenable adhesive. The table in the figure shows that the detected environmental temperature is 7.0 sec at 10° C. to 14° C., 4.0 sec at 15° C. to 19° C., 2.0 sec at 20° C. to 24° C., and 1.3 sec at 25° C. or more.

The enclosing/sealing-side control unit 60 includes an attachment maintenance time selection unit 61, a calculation processing unit 62, the comparison processing unit 63, and a discharge control unit 64.

The attachment maintenance time selection unit 61 refers to the attachment maintenance time table stored in the enclosing/sealing-side storage unit 50 and the activation condition temperature detected by the temperature detection unit 28, selects the attachment maintenance time T corresponding to the detected activation condition temperature, and outputs the value to the calculation processing unit 62.

The calculation processing unit 62 includes a discharge conveying time calculation section 62*a*, a discharge unit retaining/passing number calculation section 62*b*, a discharge unit intermittent stop time calculation section 62*c*, a discharge unit intermittent stop allowable time calculation section 62*d*, and a print set gap adjustment value calculation section 62*e*. When a sealed document preparation job is set by a user, the calculation processing unit 62 calculates various types of information that are the driving conditions for the system corresponding to the detected activation condition temperature by use of the sealed document preparation job information and the printing apparatus basic information stored in the printing-side storage unit 30, and the attachment maintenance time table and the enclosing and sealing apparatus basic information stored in the enclosing/sealing-side storage unit 50.

The discharge conveying time calculation section 62*a* uses the sealed document conveying direction length $L_4$ that is stored in the printing-side storage unit 30, the discharge unit conveying length $L_1$ and the discharge unit conveying rate $V_3$ that are stored in the enclosing/sealing-side storage unit 50, in Formula 1, to calculate a discharge conveying time $T_2$ that is the conveying time in the discharge unit 26, and outputs the result to the discharge unit retaining/passing number calculation section 62*b* and the comparison processing unit 63.

$$T_2=(L_1-L_4)/V_3 \quad \text{<<Formula 1>>}$$

The discharge unit retaining/passing number calculation section 62*b* includes an allowable capacity-passing number calculation section 62*f*, an allowable capacity-passing number maximum gap calculation section 62*g*, an envelope paper pitch calculation section 62*h*, a sealed document pitch calculation section 62*i*, an allowable capacity-passing number minimum stop time calculation section 62*j*, and an allowable capacity-passing number stop time calculation section 62*k*. The discharge unit retaining/passing number calculation section 62*b* executes a predetermined calculation process in accordance with a retaining/passing number calculation instruction from the comparison calculating unit 63, and outputs the calculation result as an allowable capacity-passing number minimum stop time $T_5$ and an allowable capacity-passing number stop time $T_6$ to the comparison processing unit 63. Furthermore, the discharge unit retaining/passing number calculation section 62*b* outputs a retaining/passing number determined with reference to the comparison result from the comparison processing unit 63 as a discharge unit retaining/passing number m to the discharge unit intermittent stop time calculation section 62*c*.

When a retaining/passing number calculation instruction is input from the comparison processing unit 63, the allowable capacity-passing number calculation section 62*f* uses the sealed document conveying direction length $L_4$, stored in the printing-side storage unit 30, the discharge unit conveying length $L_1$ and the discharge unit sealed document minimum allowable gap $G_3$ stored in the enclosed/sealed-side storage unit 50, in Formula 2, to calculate an allowable capacity passing number $m_1$ that is the maximum number of sealed documents that can be contained in the discharge unit 26, and outputs the result to the allowable capacity-passing number maximum gap calculation section 62*g*. When the maximum number of sealed documents that can be contained in the discharge unit 26 is configured by discarding values less than the decimal point when calculating the allowable capacity passing number $m_1$, the sealed documents pushed from the discharge unit 26 due to the size of the sealed document are not included in the allowable capacity number.

$$m_1=[L_1/(G_3+L_4)] \text{(discard figures below decimal point)} \quad \text{<<Formula 2>>}$$

When the allowable capacity passing number $m_1$ is inputted from the allowable capacity-passing number calculation section 62*f*, the allowable capacity-passing number maximum gap calculation section 62*g* uses the sealed document conveying direction length $L_4$ stored in the printing-side storage unit 30 and the discharge unit conveying length $L_1$ stored in the enclosed/sealed storage unit 50 in Formula 3 to calculate the allowable capacity-passing number maximum gap $G_6$ that indicates the maximum gap when the allowable capacity passing number $m_1$ is contained in the discharge unit 26, and then outputs the result to the allowable capacity-passing number minimum stop time calculation section 62*j*.

The allowable capacity-passing number maximum gap $G_6$ that is calculated in Formula 3 is the maximum sealed document gap when the allowable capacity passing number $m_1$ of sealed documents is contained in the discharge unit 26. Therefore, since the space corresponding to a figure that is less than the decimal point that is discarded in the allowable capacity passing number $m_1$ is distributed in the sealed document gap, division is performed using a figure calculated by subtracting one unit from the allowable capacity passing number $$G_6=[L_1-L_4\times m_1](m_1-1) \quad \text{<<Formula 3>>}$$

When the allowable capacity-passing number maximum gap $G_6$ is output from the allowable capacity-passing number maximum gap calculation section 62*g*, the envelope paper pitch calculation section 62*h* uses the enclosed document conveying direction length $L_2$, the envelope paper conveying direction length $L_3$, the enclosed document sheet number N, the paper gap $G_1$, and the print set basic gap $G_2$ that are stored in the printing-side storage unit 30 to calculate the envelope paper pitch $P_1$ that is the conveying pitch for envelope paper in the printing unit 13 in Formula 4 as illustrated in FIG. 3 or FIG. 4, and outputs the result to the sealed document pitch calculation section 62*i*. Since the paper gap $G_1$ takes the same value as the enclosed document sheet number N, the value of the enclosed document sheet number N is used as the value for the paper gap $G_1$ in Formula 1.

$$P_1=[L_2\times N]+(G_1\times N)+L_3+G_2 \quad \text{<<Formula 4>>}$$

The sealed document pitch calculation section 62*i* uses the printing unit conveying rate $V_1$ stored in the printing-side storage unit 30, the enclosing and sealing unit conveying rate $V_2$ stored in the enclosing/sealing-side storage unit 50, and the envelope paper pitch $P_1$ from the envelope paper pitch calculation section 62*h* in Formula 5 to calculate a sealed document pitch $P_2$ that is the conveying pitch of the sealed document in the enclosing and sealing unit 29 as illustrated in FIG. 3 and FIG. 4, and outputs the result to the allowable capacity-passing number minimum stop time calculation section 62*j* and the discharge unit intermittent stop allowable time calculation section 62*d*.

$$P_2=V_2/V_1\times P_1 \quad \text{<<Formula 5>>}$$

The allowable capacity-passing number minimum stop time calculation section 62*j* uses the enclosing and sealing unit conveying rate $V_2$ and the discharge unit conveying rate $V_3$ stored in the enclosing/sealing-side storage unit 50, the envelope paper pitch $P_2$ from the sealed document pitch calculation section 62*i*, and the allowable capacity-passing number maximum gap $G_6$ from the allowable capacity-passing number maximum gap calculation section 62*g* in Formula 6 to calculate the allowable capacity-passing number minimum stop time $T_5$ that is the minimum stop time required for the sealed document gap in the discharge unit 26 to coincide with the allowable capacity-passing number maximum gap $G_6$, and outputs the result to the comparison processing unit 63. When a comparison result is input from the comparison processing unit 63 that indicates that the allowable capacity-passing number minimum stop time $T_5$ is smaller than or equal to the allowable capacity-passing number stop time $T_6$, the allowable capacity-passing number minimum stop time calculation section 62*j* outputs the discharge unit allowable capacity passing number $m_1$ as the discharge unit retaining/passing number m to the discharge unit intermittent stop time calculation section 62*c*.

$$T_5=(P_2\times V_3/V_2-G_6)/V_2 \quad \text{<<Formula 6>>}$$

The allowable capacity-passing number stop time calculation section 62*k* uses the allowable capacity passing number $m_1$ calculated by the allowable capacity-passing number calculation section 62*f*, the discharge conveying time $T_2$ calculated by the discharge conveying time calculation section 62*a*, and the attachment maintenance time T from the attachment maintenance time selection unit 61 in Formula 7 to calculate the allowable capacity-passing number stop time $T_6$ that is the stop time that ensures the selected attachment maintenance time T when the discharge unit retaining/passing number m coincides with the allowable capacity passing number $m_1$, and outputs the result to the comparison processing unit 63. When a comparison result is input from the comparison processing unit 63 that indicates the allowable capacity-passing number minimum stop time $T_5$ is greater than the allowable capacity-passing number stop time $T_6$, the allowable capacity-passing number stop time calculation section 62*k* calculates a passing number by subtracting a value of 1 from the discharge unit allowable capacity passing number $m_1$, and outputs the value to the discharge unit intermittent stop time calculation section 62*c* as the discharge unit retaining/passing number m.

$$T_6=(T-T_2)/m_1 \quad \text{<<Formula 7>>}$$

The discharge unit intermittent stop time calculation section 62*c* uses the discharge conveying time $T_2$ calculated by the discharge conveying time calculation section 62*a*, the attachment maintenance time T from the attachment maintenance time selection unit 61, and the discharge unit retaining/passing number m from the discharge unit retaining/passing number calculation section 62*b* in Formula 8 to calculate the discharge unit intermittent stop time $T_3$ that is the stop time for intermittent driving in the discharge unit 26 that is required to satisfy the selected attachment maintenance time T, and outputs the result to the comparison processing unit 63 and the discharge control unit 64. Furthermore, when an adjustment value calculation instruction is input from the comparison processing unit 63 to the print set gap adjustment value calculation section 62*e*, the discharge unit intermittent stop time calculation section 62*c* outputs the calculated discharge unit intermittent stop time $T_3$ to the print set gap adjustment value calculation section 62*e*.

$$T_3=(T-T_2)/m \quad \text{<<Formula 8>>}$$

The discharge unit intermittent stop allowable time calculation section 62*d* uses the sealed document conveying direction length $L_4$ stored in the printing-side storage unit 30, the enclosing and sealing unit conveying rate $V_2$ stored in the enclosing/sealing-side storage unit 50, the discharge unit sealed document minimum allowable gap $G_3$ and the sealed document pitch $P_2$ from the sealed document pitch calculation section 62*i* in Formula 9 to calculate the discharge unit intermittent stop allowable time $T_4$ that is the stop time for a sealed document that is actually allowable in the discharge unit 26, and outputs the result to the comparison processing unit 63. When an adjustment value calculation instruction is input to the print set gap adjustment value calculation section 62*e* from the comparison processing unit 63, the discharge unit intermittent stop allowable time calculation section 62*d* outputs the calculated discharge unit intermittent stop allow able time $T_4$ to the print set gap adjustment value calculation section 62*e*.

$$T_4=(P_2-L_4-G_3)/V_2 \quad \text{<<Formula 9>>}$$

In accordance with the adjustment value calculation instruction from the comparison processing unit 63, the print set gap adjustment value calculation section 62*e* uses the printing unit conveying rate $V_1$ stored in the printing-side storage unit 30, the enclosing and sealing unit conveying rate $V_2$ stored in the enclosing/sealing-side storage unit 50, the discharge unit intermittent stop time $T_3$ from the discharge unit intermittent stop time calculation section 62*c*, and the discharge unit intermittent stop allowable time $T_4$ from the discharge unit intermittent stop allowable time calculation section 62*d* in Formula 10 to calculate the print set gap adjustment value $G_2'$ that is configured to adjust the gap between print sets, and outputs the result to the comparison processing unit 63.

$$G_2=(T_3-T_4)\times V_2\times V_1/V_2 \quad \text{<<Formula 10>>}$$

The comparison processing unit 63 performs a comparison of the attachment maintenance time T and the discharge conveying time $T_2$, a comparison of the allowable capacity-passing number minimum stop time $T_5$ and the allowable capacity-passing number stop time $T_6$, and a comparison of the discharge unit intermittent stop time $T_3$, and the discharge unit intermittent stop allowable time $T_4$, and executes processing corresponding to the respective comparison results.

The details of the three comparisons will be described below.

(Comparison of Attachment Maintenance Time T and Discharge Conveying Time $T_2$)

The comparison processing unit 63 compares the dimensional relationship between the attachment maintenance time T corresponding to the detected activation condition temperature and the discharge conveying time $T_2$ from the discharge conveying time calculation section 62*a*.

When the result of the comparison indicates that the attachment maintenance time T is smaller than or equal to the discharge conveying time $T_2$, since a gap correction between the print sets in the printing unit 13 and intermittent driving of the discharge unit 26 are not required, and the attachment maintenance time T is satisfied by the normal driving control, the basic drive control information indicating the determination result is output to the printing-side control unit 40 and the discharge control unit 64.

When the attachment maintenance time T is greater than the discharge conveying time $T_2$, the attachment maintenance time T cannot be satisfied by normal driving control with the settings for the sealed document preparation job, and intermittent driving in the discharge unit 26 is required as a supplementary sealing process. Therefore, a retaining/passing calculation instruction is output to the discharge unit retaining/passing number calculation section 62*b* in order to calculate the allowable capacity passing number $m_1$ used in the calculation of the discharge unit intermittent stop time $T_3$.

(Comparison Process of Allowable Capacity-passing Number Minimum Stop Time $T_5$ and Allowable Capacity-Passing Number Stop Time $T_6$)

The comparison processing unit 63 compares the dimensional relationship between the allowable capacity-passing number minimum stop time $T_5$ from the allowable capacity-passing number minimum stop time calculation section 62*j* and the allowable capacity-passing number stop time $T_6$ from the allowable capacity-passing number stop time calculation section 62*k*, and outputs the comparison result to the discharge unit retaining/passing number calculation section 62*b*.

(Comparison Process of Discharge Unit Intermittent Stop Time $T_3$, and Discharge Unit Intermittent Stop Allowable Time $T_4$)

The comparison processing unit 63 compares the dimensional relationship between the discharge unit intermittent stop time $T_3$ from the discharge unit intermittent stop time calculation section 62*c*, and the discharge unit intermittent stop allowable time $T_4$ from the discharge unit intermittent stop allowable time calculation section 62*d*.

When the result of the comparison indicates that the discharge unit intermittent stop allowable time $T_4$ is greater than or equal to the discharge unit intermittent stop time $T_3$, the comparison processing unit 63 outputs gap control information (normal gap control information) to control the print set gap in the printing unit 13 with a print set gap execution value $G_5$ to the printing-side control unit 40 using the preset print set basic gap $G_2$ as the print set gap execution value $G_5$.

When the discharge unit intermittent stop allowable time $T_4$ is smaller than the discharge unit intermittent stop time $T_3$, an adjustment value calculation instruction for calculation of the print set gap adjustment value $G_2'$ that is added to the preset print set basic gap $G_2$ is output to the print set gap adjustment value calculation section 62*e*. When the print set gap adjustment value $G_2'$ is inputted from the print set gap adjustment value calculation section 62*e*, gap control information (gap adjustment control information) to control the print set gap in the printing unit 13 with a print set gap execution value $G_5$ calculated by adding the print set gap adjustment value $G_2'$ input to the print set basic gap $G_2$ is output to the printing-side control unit 40.

The discharge control unit 64 drives and controls the discharge unit 26 at the discharge unit conveying rate $V_3$ that is preset in the enclosing and sealing apparatus basic information. Furthermore, when the discharge unit intermittent stop time $T_3$ is input from the calculation processing unit 62, the discharge control unit 64 intermittently drives the discharge unit 26 in accordance with the information. In this manner, the discharge unit 26 is driven and controlled to satisfy the attachment maintenance time T corresponding to the activation condition temperature.

<First Embodiment of Processing Operation>

Next, the discharge processing operation corresponding to the activation condition temperature in the sealed document preparation system 1 according to the first embodiment will be described.

Firstly, when the sealed document preparation job information for preparation of a sealed document is set by a user, the enclosing/sealing-side control unit 60 refers to the activation condition temperature detected by the temperature detection unit 28 and the attachment maintenance time table stored in the enclosing/sealing-side storage unit 50, and selects an attachment maintenance time T corresponding to the current activation condition temperature.

Next, the discharge conveying time $T_2$ is calculated from the printing apparatus basic information (sealed document conveying direction length $L_4$), the enclosing and sealing apparatus basic information (discharge unit conveying length $L_1$, discharge unit conveying rate $V_3$), and the dimensional relationship with the attachment maintenance time T selected by the comparison processing unit 63 is compared.

When the attachment maintenance time T is smaller than or equal to the discharge conveying time $T_2$, the printing unit 13 is driven and controlled under normal driving conditions without intermittent driving of the discharge unit 26 in accordance with the basic drive control information.

When the attachment maintenance time T is greater than the discharge conveying time $T_2$, the discharge unit intermittent stop time $T_3$ is calculated from the attachment maintenance time T, the discharge conveying time $T_2$, and the allowable capacity passing number $m_1$ calculated by the discharge unit retaining/passing number calculation section 62*b* to execute intermittent driving in the discharge unit 26. In addition, the discharge unit intermittent stop allowable time $T_4$ is calculated from the printing apparatus basic information (sealed document conveying direction length $L_4$), the enclosing and sealing apparatus basic information (enclosing/sealing unit conveying rate $V_2$, discharge unit sealed document minimum allowable gap $G_3$), and the sealed document pitch $P_2$, and the dimensional relationship between these values is compared.

When the discharge unit intermittent stop time $T_3$ is calculated, the dimensional relationship between the allowable capacity-passing number minimum stop time $T_5$ that is calculated from the enclosing and sealing apparatus basic information (enclosing/sealing unit conveying rate $V_2$, discharge unit conveying rate $V_3$), the sealed document pitch $P_2$, and the allowable capacity-passing number maximum gap $G_6$, and the allowable capacity-passing number stop time $T_6$ that is calculated from the attachment maintenance time T, the discharge conveying time $T_2$, and the allowable capacity passing number $m_1$, is compared. When the allowable capacity-passing number minimum stop time $T_5$ is smaller than or equal to the allowable capacity-passing number minimum stop time $T_6$, the allowable capacity passing number $m_1$ is configured as the discharge unit retaining/passing number m, and when the allowable capacity-passing number minimum stop time $T_5$ is greater than the allowable capacity-passing number minimum stop time $T_6$, a passing number calculated by subtracting a value of 1 from the discharge unit allowable capacity passing number $m_1$ is configured as the discharge unit retaining/passing number m.

Next, when the result of the comparison of the dimensional relationship of the discharge unit intermittent stop time $T_3$ and the discharge unit intermittent stop allowable time $T_4$ shows that the discharge unit intermittent stop allowable time $T_4$ is greater than or equal to the discharge unit intermittent stop time $T_3$, the print set basic gap $G_2$ is output as the print set gap execution value $G_5$ to the printing-side control unit 40 as normal gap control information for controlling the print set gap, and the conveying rate, the paper conveying timing, or the like of the printing unit 13 is adjusted and controlled.

When the discharge unit intermittent stop allowable time $T_4$ is smaller than the discharge unit intermittent stop time $T_3$, gap adjustment control information for controlling the print set gap is output to the printing-side control unit 40 with the print set gap execution value $G_5$ obtained by adding the print set gap adjustment value $G_2'$ to the preset print set basic gap $G_2$, and the conveying rate, the paper conveying timing, or the like of the printing unit 13 is adjusted and controlled.

Thereby, an optimal enclosing and sealing process is performed corresponding to the detected activation condition temperature by driving and controlling the printing apparatus 10 and the enclosing and sealing apparatus 20 using any of the basic drive control information, the normal gap control information and the gap adjustment control information.

<Second Embodiment>

Next, the system configuration according to a second embodiment of the sealed document preparation system 1 in the present example will be described.

Figure 6:
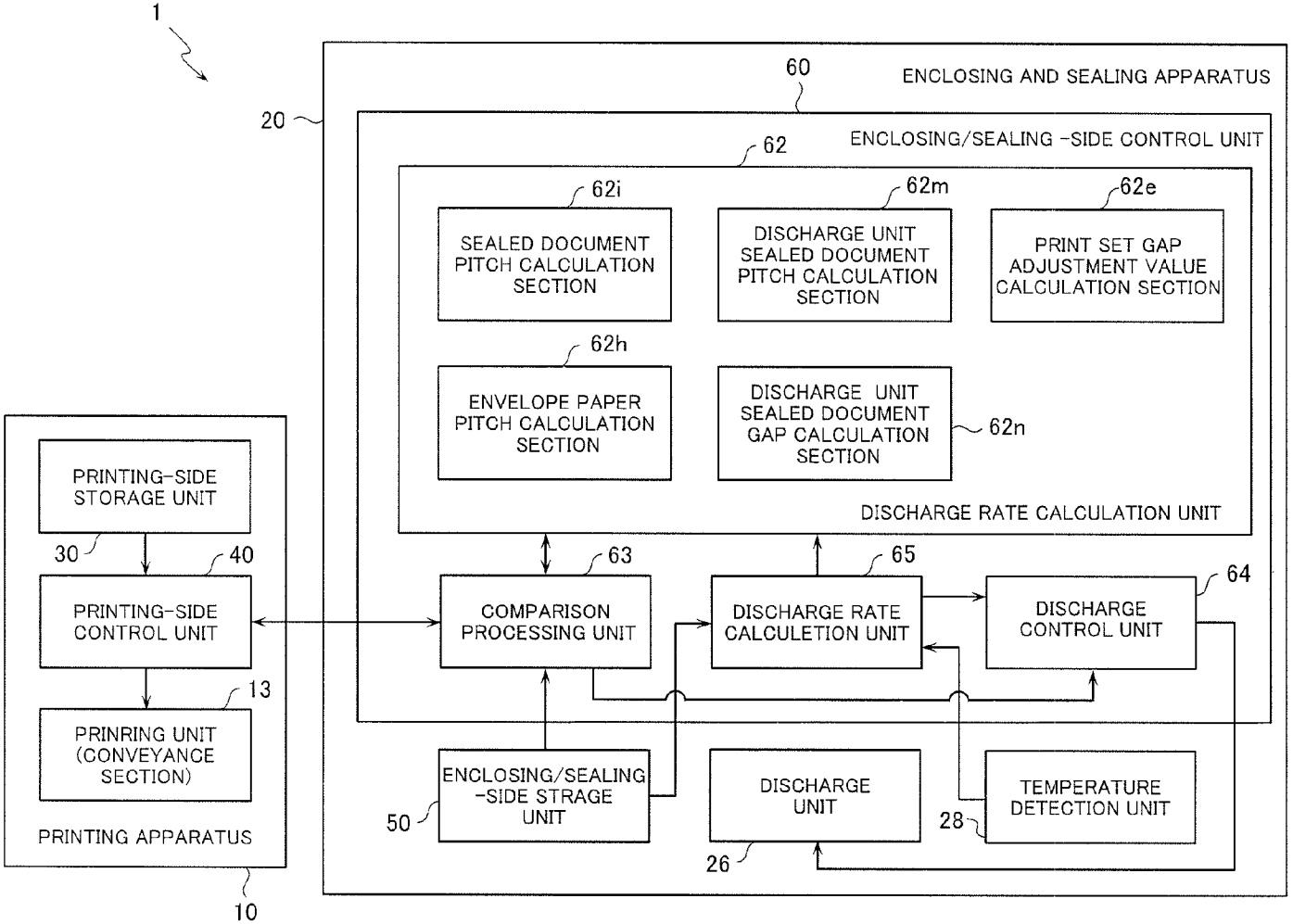
[FIG. 6] is a functional block diagram illustrating the system configuration according to a second embodiment of the apparatus.

In the system configuration according to the second embodiment, those elements of configuration that are the same as the first embodiment are denoted by the same reference numerals and the description will not be repeated. Only those constituent elements that are important for the present embodiment will be described. Furthermore, in FIG. 6, in the same manner as the first embodiment, the function of the integrated storage unit 2 and the integrated control unit 3 in the sealed document preparation system according to the second embodiment will be specified by description of a system configuration that includes the function of respective storage units (printing-side storage unit 30 and enclosing/sealing-side storage unit 50) and a control unit (printing-side control unit 40 and enclosing/sealing-side control unit 60) in the printing apparatus 10 and the enclosing and sealing apparatus 20.

The system configuration according to the second embodiment varies the conveying rate of the discharge unit 26 to coincide with an optimal attachment maintenance time T corresponding to the detected activation condition temperature. Therefore, in the second embodiment, in substitution for the attachment maintenance time selection unit 61, the discharge unit retaining/passing number calculation section 62*b*, the discharge unit intermittent stop time calculation section 62*c*, and the discharge unit intermittent stop allowable time calculation section 62*d* in the system configuration according to the first embodiment, an arrangement is newly configured with a discharge rate calculation unit 65, a discharge unit sealed document pitch calculation section 62*m* and a discharge unit sealed document gap calculation section 62*n*.

That is to say, the enclosing/sealing-side control unit 60 includes the calculation processing unit 62, the comparison processing unit 63, the discharge control unit 64, and the discharge rate calculation unit 65. Furthermore, the calculation processing unit 62 includes the print set gap adjustment value calculation section 62*e*, the envelope paper pitch calculation section 62*h*, the sealed document pitch calculation section 62*i*, the discharge unit sealed document pitch calculation section 62*m* and the discharge unit sealed document gap calculation section 62*n*.

The discharge rate calculation unit 65 calculates the discharge unit conveying rate $V_3$ corresponding to the current activation condition temperature using the attachment maintenance time T selected from the activation condition temperature detected by the temperature detection unit 28, and the discharge unit conveying length $L_1$ stored in the enclosing/sealing-side storage unit 50, and outputs the result to the discharge control unit 64. Furthermore, the discharge rate calculation unit 65 outputs the calculated discharge unit conveying rate $V_3$ to the calculation processing unit 62.

When the discharge unit conveying length $L_1$ is 255 mm, and the attachment maintenance time T specified in the attachment maintenance time table is used in the calculation, an example of the calculation of the discharge unit conveying rate $V_3$ is 36.4 mm/s at 10° C. to 14° C., 63.8 mm/s at 15° C. to 19° C., 127.5 mm/s at 20° C. to 24° C., and 1962 mm/s at 25° C. or more. The discharge rate calculation unit 65 outputs the calculated rate information to the calculation respectively to the calculation processing unit 62 and the discharge control unit 64.

The discharge unit sealed document pitch calculation section 62*m* uses the enclosing and sealing unit conveying rate $V_2$ stored in the enclosing/sealing-side storage unit 50, the discharge unit conveying rate $V_3$ selected by the discharge rate calculation unit 65, and the sealed document pitch $P_2$ from the sealed document pitch calculation section 62*h* in Formula 11 below to calculate a discharge unit sealed document pitch $P_3$ that is the discharge pitch of the sealed document in the discharge unit 26 as illustrated in FIG. 3 and FIG.

4, and outputs the result to the discharge unit intermittent stop allowable time calculation section 62*n*.

$$P_3=V_3\times P_2/V_2 \quad \text{<<Formula 11>>}$$

The discharge unit sealed document gap calculation section 62*n* uses the discharge unit sealed document pitch $P_3$ from the discharge unit sealed document pitch calculation section 62*m*, and the sealed document conveying direction length $L_4$ stored in the printing-side storage unit 30 in Formula 12 below to calculate a discharge unit sealed document gap $G_4$ that is the gap between the sealed documents in the discharge unit 26 as illustrated in FIG. 3 and FIG. 4, and outputs the result to the comparison processing unit 63. Furthermore, the discharge unit sealed document gap calculation section 62*n* receives input of the adjustment value calculation instruction from the comparison processing unit 63, and outputs the calculated discharge unit sealed document gap $G_4$ to the print set gap adjustment value calculation section 62*e*.

$$G_4=P_3-L_4 \quad \text{<<Formula 12>>}$$

In accordance with the adjustment value calculation instruction from the comparison calculation unit 63, the print set gap adjustment value calculation section 62*e* uses the enclosing and sealing unit conveying rate $V_2$ stored in the enclosing/sealing-side storage unit 50, the discharge unit conveying rate $V_3$ selected by the discharge rate calculation unit 65, the discharge unit sealed document minimum allowable gap $G_3$ stored in the enclosing/sealing-side storage unit 50, and the discharge unit sealed document gap $G_4$ from the discharge unit sealed document gap calculation section 62*n* in Formula 13 below to calculate the print set gap adjustment value $G_2'$ to adjust the print set gap, and outputs the result to the comparison processing unit 63.

$$G_2'=V_2(G_3-G_4)/V_3 \quad \text{<<Formula 13>>}$$

The comparison processing unit 63 compares the dimensional relation of the discharge unit sealed document gap $G_4$ from the discharge unit sealed document gap calculation section 62*n* and the preset discharge unit sealed document minimum allowable gap $G_3$ to thereby calculate a print set gap execution value $G_5$ of the printing apparatus 10 corresponding to the comparison result, and outputs the gap control information (normal gap control information, gap adjustment control information) to the printing-side control unit 40 to execute printing gap control using the print set gap execution value $G_5$.

More specifically, when the discharge unit sealed document gap $G_4$ is greater than or equal to the discharge unit sealed document minimum allowable gap $G_3$, the preset print set basic gap $G_2$ is configured as the print set gap execution value $G_5$, and the gap control information (normal gap control information) is output to the printing-side control unit 40 to control the print set gap in the printing unit 13 using the print set gap execution value $G_5$.

When the discharge unit sealed document gap $G_4$ is smaller than the discharge unit sealed document minimum allowable gap $G_3$, gap control information (gap adjustment control information) for controlling the print set gap in the printing unit 13 is output to the printing-side control unit 40 with the print set gap execution value $G_5$ obtained by adding a print set gap adjustment value $G_2'$ calculated in the print set gap adjustment value calculation section 62*e* to the preset print set basic gap $G_2$.

When the discharge unit sealed document gap $G_4$ is less than the preset discharge unit sealed document minimum allowable gap $G_3$, the comparison processing unit 63 outputs the adjustment value calculation instruction for calculation of the print set gap adjustment value $G_2'$ to the print set gap adjustment value calculation section 62*e*.

<Second Embodiment of Processing Operation>

Next, the discharge processing operation corresponding to the activation condition temperature in the sealed document preparation system 1 according to the second embodiment will be described.

Firstly, when the sealed document preparation job information for preparation of a sealed document is set by a user, the enclosing/sealing-side control unit 60 refers to the activation condition temperature detected by the temperature detection unit 28 and the attachment maintenance time table stored in the enclosing/sealing-side storage unit 50 to calculate the discharge unit conveying rate $V_3$ corresponding to the current activation condition temperature.

Next, the discharge unit sealed document gap $G_4$ is calculated from the sealed document preparation job information (enclosed document conveying direction length $L_2$, envelope paper conveying direction length $L_3$, sealed document conveying direction length $L_4$, enclosed document sheet number N), the printing apparatus basic information (paper gap $G_1$, print set basic gap $G_2$, printing unit conveying rate $V_1$), and the enclosing and sealing apparatus basic information (discharge unit sealed document minimum allowable gap $G_3$, enclosing and sealing unit conveying rate $V_2$, discharge unit conveying length $L_1$).

Thereafter, the dimensional relationship between the calculated discharge unit sealed document gap $G_4$ and the discharge unit sealed document minimum allowable gap $G_3$ is compared to thereby determine whether or not the discharge unit sealed document gap $G_4$ is less than the discharge unit sealed document minimum allowable gap $G_3$. When the determined result indicates that the discharge unit sealed document gap $G_4$ is greater than or equal to the discharge unit sealed document minimum allowable gap $G_3$, the print set basic gap $G_2$ is configured as the print set gap execution value $G_5$ and the normal gap control information is output to the printing-side control unit 40 in order to control the print set gap, and adjust and control the conveying rate and the paper conveying timing or the like of the printing unit 13.

When the determination result indicates that the discharge unit sealed document gap $G_4$ is smaller than the discharge unit sealed document minimum allowable gap $G_3$, the print set gap adjustment value $G_2'$ is calculated, and gap adjustment control information is output to the printing-side control unit 40 to control the print set gap with the print set gap execution value $G_5$ that is calculated by adding the print set gap adjustment value $G_2'$ to the print set basic gap $G_2$, and thereby to adjust and control the conveying rate and the paper conveying timing or the like of the printing unit 13.

The print set gap of the printing unit 13 is controlled with reference to the normal gap control information or the gap adjustment control information, and driving and control of the discharge unit 26 is controlled using the discharge unit conveying rate $V_3$ that is calculated with reference to the activation condition temperature to thereby perform sealed document preparation processing.

As described above, the system configuration according to the first embodiment of the sealed document preparation system 1 above is configured to firstly refer to an activation condition temperature detected by the temperature detection unit 28 and an attachment maintenance time table stored in the enclosing/sealing-side storage unit 50 to thereby select an attachment maintenance time T corresponding to the current activation condition temperature. Next, the attachment maintenance time T is compared with the discharge conveying time $T_2$, and when the attachment maintenance time T is smaller than or equal to the discharge conveying time $T_2$, the system is driven and controlled in accordance with the basic drive control information, and when the attachment maintenance time T is greater than the discharge conveying time $T_2$, the discharge unit intermittent stop time $T_3$ and the discharge unit intermittent stop allowable time $T_4$ are calculated to perform intermittent driving as a supplementary enclosing process in the discharge unit 26, and then the dimensional relationship between these values is compared.

When the result of the dimensional comparison of the discharge unit intermittent stop time $T_3$ and the discharge unit intermittent stop allowable time $T_4$ indicates that the discharge unit intermittent stop allowable time $T_4$ is greater than or equal to the discharge unit intermittent stop time $T_3$, the print set basic gap $G_2$ is configured as the print set gap execution value $G_5$, and gap control information is output to the printing-side control unit 40 to control the print set gap to execute sealed document preparation processing while adjusting and controlling the conveying rate, the paper conveying timing or the like of the printing unit 13. Furthermore, when the discharge unit intermittent stop allowable time $T_4$ is smaller than the discharge unit intermittent stop time $T_3$, gap adjustment and control information that is gap control information to control the print set gap is output to the printing-side control unit 40 using the print set gap execution value $G_5$ calculated by adding the print set gap adjustment value $G_2'$ to the preset print set basic gap $G_2$ to thereby execute sealed document preparation processing while adjusting and controlling the conveying rate, the paper conveying timing or the like of the printing unit 13.

In this manner, sealing and attachment can be ensured by configuring the remoistenable adhesive in an active state in the discharge unit 26 without affecting the activation temperature by intermittently driving the discharge unit 26 to satisfy the attachment maintenance time T that corresponds to the detected activation condition temperature.

Since the discharge unit 26 is intermittently driven as required corresponding to the detected activation condition temperature, and print set gap adjustment control is performed in the printing unit 13 as required to so that the sealed document gap in the discharge unit 26 is greater than or equal to the discharge unit sealed document minimum allowable gap $G_3$, a supplementary sealing process is further performed in relation to the prepared sealed document, and thereby further enhances sealing performance.

Furthermore, during intermittent driving of the discharge unit 26, the print set gap adjustment value $G_2'$ is only calculated when the discharge unit sealed document gap $G_4$ is smaller than the discharge unit sealed document minimum allowable gap $G_3$, and adjustment and control of the printing unit 13 is performed so that the print set gap of the printing unit 13 coincides with the print set gap obtained by adding the print set gap adjustment value $G_2'$ to the print set basic gap $G_2$, and thereby further reduces the processing load on the integrated control unit 3 prior to printing commencement.

The system configuration according to the second embodiment of the sealed document preparation system 1 above is configured to firstly refer to an activation condition temperature detected by the temperature detection unit 28 and an attachment maintenance time table stored in the enclosing/sealing-side storage unit 50 to thereby calculate the discharge unit conveying rate $V_3$ of the discharge unit 26 so that the attachment maintenance time T corresponding to the current activation condition temperature is satisfied. Next, the printing apparatus basic information and the sealed document preparation job information stored in the printing-side storage unit 30, and the sealing/enclosing apparatus basic information stored in the enclosing/sealing-side storage unit 50 are used to calculate the discharge unit sealed document gap $G_4$ when driving the discharge unit 26 at the discharge unit conveying rate $V_3$.

When the dimensional relationship of the preset discharge unit sealed document minimum allowable gap $G_3$ and the calculated discharge unit sealed document gap $G_4$ is compared, and the discharge unit sealed document gap $G_4$ is greater than or equal to the discharge unit sealed document minimum allowable gap $G_3$, the sealed document preparation process is executed while adjusting and controlling the conveying rate, the paper conveying time or the like in the discharge unit 13 with the printing-side control unit 40 so that the print set gap coincides with the print set basic gap $G_2$. Furthermore, when the calculated discharge unit sealed document gap $G_4$ is smaller than the discharge unit sealed document minimum allowable gap $G_3$, the sealed document preparation process is executed while adjusting and controlling the conveying rate, the paper conveying time or the like in the discharge unit 13 with the printing-side control unit 40 in accordance with the acquired gap adjustment control information so that the print set gap coincides with the print set gap obtained by adding the print set gap adjustment value $G_2'$ to the print set basic gap $G_2$.

In this manner, sealing and attachment can be ensured by configuring the remoistenable adhesive in an active state in the discharge unit 26 without affecting the activation temperature by varying the discharge rate of the discharge unit 26 corresponding to the detected activation condition temperature.

Since the discharge rate of the discharge unit 26 is varied corresponding to the detected activation condition temperature, and the print set gap in the printing unit 13 is adjusted and controlled as required so that the sealed document gap of the discharge unit 26 is greater than or equal to the discharge unit sealed document minimum allowable gap $G_3$, a further supplementary sealing process is executed in relation to the prepared sealed document, and thereby sealing is further enhanced.

Furthermore, the print set gap adjustment value $G_2'$ is only calculated when the discharge unit sealed document gap $G_4$ is smaller than the discharge unit sealed document minimum allowable gap $G_3$, and adjustment and control of the printing unit 13 is performed so that the print set gap of the printing unit 13 coincides with the print set gap obtained by adding the print set gap adjustment value $G_2'$ to the print set basic gap $G_2$, and thereby further reduces the processing load on the integrated control unit 3 prior to printing commencement.

[Other Embodiments]

The present invention is not limited to the above embodiment, and may be executed by suitable modification corresponding to conditions such as those described below. Furthermore, execution is possible to arbitrary combination of the following modified examples.

In each of the above embodiments, although an attachment maintenance time table (reference is made to FIG. 5) is described which associates in the form of a table the attachment maintenance time T and the activation condition temperature corresponding to a single type of remoistenable adhesive, when a different remoistenable adhesive is used depending on the sealed document for example, storage in the form of a table is possible in relation to each type of remoistenable adhesive that can be used or the attachment maintenance time T that is suitable for the activation condition temperature. In this configuration, the attachment maintenance time T can be selected that is suitable to the type of remoistenable adhesive that is specified from the job details of the sealed document preparation job.

In each of the above embodiments, although a configuration has been described in which the printing apparatus 10 includes an integrated storage unit 2 that stores each type of information required for driving of the system and the integrated control unit 3 that integrally controls the system driving control, the present invention is not limited thereby. The system configuration includes a configuration provided to the enclosing and sealing apparatus 20, and a configuration in which the storage unit and the control unit are independently provided to the printing apparatus 10 and the enclosing and sealing apparatus 20.

Furthermore, in the second embodiment, although the discharge unit sealed document minimum allowable gap $G_3$ is a gap between sealed documents that are conveyed in the discharge unit 26, the gap between the sealed documents is not necessarily a positive number, and for example, when set as the thickness of the prepared sealed document that does not impede conveying and discharging even when the sealed documents are in an overlapping configuration, the discharge unit sealed document minimum allowable gap $G_3$ may be a negative number that enables conveying and discharge when only in a predetermined amount of overlap.

REFERENCE SIGNS LIST

1 SEALED DOCUMENT PREPARATION SYSTEM
2 INTEGRATED STORAGE UNIT
3 INTEGRATED CONTROL UNIT
10 PRINTING APPARATUS
11 GUIDE PATH
12 CONVEYANCE PATH
13 PRINTING UNIT
14 FIRST DISCHARGE UNIT
15 SECOND DISCHARGE UNIT
16 SWITCH BACK PATH
20 ENCLOSING AND SEALING APPARATUS
21 ENCLOSED DOCUMENT FOLDING UNIT
22 ENVELOPE PAPER FOLDING UNIT
23 ENCLOSING UNIT
24 WATER COATING PROCESS UNIT
25 SEALING UNIT
26 DISCHARGE UNIT
27 DISCHARGE PLATE
28 TEMPERATURE DETECTION UNIT
29 ENCLOSING AND SEALING UNIT
30 PRINTING-SIDE STORAGE UNIT
40 PRINTING-SIDE CONTROL UNIT
50 ENCLOSING/SEALING-SIDE STORAGE UNIT
60 ENCLOSING/SEALING-SIDE CONTROL UNIT
62 DISCHARGE RATE CALCULATION UNIT
(62*a* . . . DISCHARGE CONVEYING TIME CALCULATION SECTION, 62*b* . . . DISCHARGE UNIT RETAINING/PASSING NUMBER CALCULATION SECTION, 62*c* . . . DISCHARGE UNIT INTERMITTENT STOP TIME CALCULATION SECTION, 62*d* . . . DISCHARGE UNIT INTERMITTENT STOP ALLOWABLE TIME CALCULATION SECTION, 62*e* . . . PRINT SET GAP ADJUSTMENT VALUE CALCULATION SECTION, 62*f* . . . ALLOWABLE CAPACITY-PASSING NUMBER CALCULATION SECTION, 62*g* . . . ALLOWABLE CAPACITY-PASSING NUMBER MAXIMUM GAP CALCULATION SECTION, 62*h* . . . ENVELOPE PAPER PITCH CALCULATION SECTION, 62*i* . . . SEALED DOCUMENT PITCH CALCULATION SECTION, 62*j* . . . ALLOWABLE CAPACITY-PASSING NUMBER MINIMUM STOP TIME CALCULATION SECTION, 62*k* . . . ALLOWABLE CAPACITY-PASSING NUMBER STOP TIME CALCULATION SECTION, 62*m* . . . DISCHARGE UNIT SEALED DOCUMENT PITCH CALCULATION SECTION, 62*n* . . . DISCHARGE UNIT SEALED DOCUMENT GAP CALCULATION SECTION)
63 COMPARISON PROCESSING UNIT
64 DISCHARGE CONTROL UNIT
65 DISCHARGE RATE CALCULATION UNIT

The invention claimed is:

1. A sealed document preparation system comprising:

a printing apparatus including a printing unit configured to perform a desired printing process during conveying of envelope paper that is a sealed document and of printing paper that is a document to be enclosed, an enclosing and sealing apparatus including an enclosing and sealing unit configured to enclose the document to be enclosed in an envelope formed by folding of the envelope paper input from the printing apparatus, and perform sealing after executing a water coating process onto the remoistenable adhesive on the envelope, and a discharge unit configured to grip both surfaces of the sealed document with a predetermined pressure and convey and discharge the sealed document that is prepared in the enclosing and sealing unit, a temperature detection unit configured to detect an activation condition temperature that is the condition temperature causing activation of the remoistenable adhesive that is coated with water, an integrated storage unit configured to store an attachment maintenance time selection condition for determining the attachment maintenance time of the remoistenable adhesive in accordance with the activation condition temperature that is detected by the temperature detection unit, and an integrated control unit configured to drive and control the discharge unit to satisfy the attachment maintenance time determined corresponding to the activation condition temperature detected by the temperature detection unit.

2. The sealed document preparation system according to claim 1, wherein the integrated storage unit stores printing conditions in relation to the printing apparatus and enclosing and sealing conditions in relation to the enclosing and sealing apparatus, the integrated control unit calculates a discharge conveying time for the sealed document in the discharge unit based on the printing conditions and the enclosing and sealing conditions, and when the discharge conveying time is less than the attachment maintenance time determined from the activation condition temperature, the discharge unit is intermittently driven and controlled to drive at a preset discharge unit conveying rate.

3. The sealed document preparation system according to claim 2, wherein the integrated storage unit further stores a sealed document preparation condition for the sealed document to be prepared, and the integrated control unit calculates a discharge unit intermittent stop allowable time and a discharge unit intermittent stop time for the discharge unit based on the sealed document preparation condition, the printing condition and the enclosing and sealing condition, and when the discharge unit intermittent stop allowable time is less than the discharge intermittent stop time, control is performed to suitably adjust the printing conditions of the printing apparatus.

4. The sealed document preparation system according to claim 1, wherein the integrated storage unit stores a sealed document preparation condition for a sealed document to be prepared, printing conditions for the printing apparatus, and an enclosing/sealing condition for the enclosing and sealing apparatus, and the integrated control unit drives and controls the discharge unit at a discharge conveying rate that is calculated from an attachment maintenance time T that corresponds to the activation condition temperature detected by the temperature detection unit, and the enclosing/sealing condition, and calculates a sealed document gap in the discharge unit based on the sealed document preparation condition, the printing condition and the enclosing/sealing condition, and when the sealed document gap is less than a preset minimum allowable gap value, the printing condition for the printing apparatus is suitably adjusted and controlled.

5. The sealed document preparation system according to claim 3, wherein the sealed document preparation condition includes an enclosed document conveying direction length $L_2$, an envelope paper conveying direction length $L_3$, a sealed document conveying direction length $L_4$, and an enclosed document sheet number N, the printing condition includes a paper gap $G_1$, a print set basic gap $G_2$, and a printing unit conveying rate $V_1$, the enclosing/sealing conditions include a discharge unit sealed document minimum allowable gap $G_3$, an enclosing and sealing unit conveying rate $V_2$, a discharge unit conveying length $L_1$, and a discharge unit conveying rate $V_3$, the attachment maintenance time selection condition is configured as an attachment maintenance time table that associates the activation condition temperature detected by the temperature detection unit with the attachment maintenance time T that is required for the remoistenable adhesive specified for each activation condition temperature, and the integrated control unit calculates a discharge conveying time based on the discharge unit conveying length $L_1$ and the sealed document conveying direction length $L_4$, and selects the attachment maintenance time T corresponding to the activation condition temperature by making reference to the activation condition temperature detected by the temperature detection unit and the attachment maintenance time table stored in the integrated storage unit, and when the calculated discharge conveying time is less than the attachment maintenance time T, the discharge unit that drives at a discharge unit conveying rate $V_3$ is driven and controlled intermittently.

6. The sealed document preparation system according to claim 5, wherein the integrated control unit further uses the sealed document preparation condition, the printing condition, and the enclosing/sealing condition to calculate a discharge unit intermittent stop time $T_3$ that is the stop time during intermittent driving in the discharge unit required to satisfy the attachment maintenance time T, and a discharge unit intermittent stop allowable time $T_4$ that is the stop time that is allowable during intermittent driving, and when the discharge unit intermittent stop allowable time $T_4$ is less than the discharge unit intermittent stop time $T_3$, a print set gap adjustment value $G_2'$ that is the gap adjustment value between print sets in the printing unit is calculated based on the sealed document preparation condition, the printing condition, and the enclosing/sealing condition, and the printing unit is driven and controlled to coincide with a print set gap that is obtained by adding the print set gap adjustment value $G_2'$ to the print set basic gap $G_2$.

7. The sealed document preparation system according to claim 6, wherein the integrated control unit includes:

an attachment maintenance time selection unit that refers to the activation condition temperature detected by the temperature detection unit and the attachment maintenance time table that is stored in the integrated storage unit to select and output an attachment maintenance time T corresponding to the currently detected activation condition temperature, a discharge conveying time calculation section configured to calculate the discharge conveying time $T_2$ based on the discharge unit conveying length $L_1$, the sealed document conveying direction length $L_4$, and the discharge unit conveying rate $V_3$ that are stored in the integrated storage unit, a discharge unit retaining/passing number calculation section configured to use the discharge unit conveying length $L_1$, the enclosed document conveying direction length $L_2$, the envelope paper conveying direction length $L_3$, the sealed document conveying direction length $L_4$, the enclosed document sheet number N, the print set basic gap $G_2$, the printing unit conveying rate $V_1$, the enclosing and sealing unit conveying rate $V_2$, and the discharge unit conveying rate $V_3$ to calculate an allowable capacity-passing number minimum stop time $T_5$ and an allowable capacity-passing number stop time $T_6$ in the discharge unit, and acquire the retaining/passing number of the sealed document in the discharge unit as the discharge unit retaining/passing number m with reference to the dimensional relationship of the allowable capacity-passing number minimum stop time $T_5$ and the allowable capacity-passing number stop time $T_6$, a discharge unit intermittent stop time calculation section configured to use the attachment maintenance time T selected by the attachment maintenance time selection unit, the discharge conveying time $T_2$ calculated by the discharge conveying time calculation unit, and the discharge unit retaining/passing number m calculated by the discharge unit retaining/passing number calculation section to calculate the discharge unit intermittent stop time $T_3$, a discharge unit intermittent stop allowable time calculation section configured to use the discharge unit conveying length $L_1$, the enclosed document conveying direction length $L_2$, the envelope paper conveying direction length $L_3$, and the sealed document conveying direction length $L_4$, the enclosed document sheet number N, the print set basic gap $G_2$, the printing unit conveying rate $V_1$, the enclosing and sealing unit conveying rate $V_2$, and the discharge unit conveying rate $V_3$ that are stored in the integrated storage unit to calculate the discharge unit intermittent stop allowable time $T_4$, a print set gap adjustment value calculation section configured to use the printing unit conveying rate $V_1$ and the enclosing and sealing unit conveying rate $V_2$ that are stored in the integrated storage unit, the discharge unit intermittent stop time $T_3$ that is calculated by the discharge unit intermittent stop time calculation section and the discharge unit intermittent stop allowable time $T_4$ that is calculated by the discharge unit intermittent stop allowable time calculation section to calculate the print set gap adjustment value $G_2'$, a comparison processing unit configured to compare the dimensional relationship between the discharge unit intermittent stop time $T_3$ that is calculated by the discharge unit intermittent stop time calculation section and the discharge unit intermittent stop allowable time $T_4$ that is calculated by the discharge unit intermittent stop allowable time calculation section, and when the discharge unit intermittent stop allowable time $T_4$ is less than discharge unit intermittent stop time $T_3$, to output gap adjustment control information to control the print set gap in the printing unit with a print set gap execution value $G_5$ that is obtained by adding the print set gap adjustment value $G_2'$ calculated by the print set gap adjustment value calculation section to the print set basic gap $G_2$, a discharge control unit configured to intermittently drive and control the discharge unit in accordance with the discharge unit intermittent stop time $T_3$ that is calculated by the discharge unit intermittent stop time calculation section, and a printing-side control unit that is configured to adjust and control the driving of the printing unit to coincide with the print set gap according to the gap adjustment control information from the comparison processing unit.

8. The sealed document preparation system according to claim 7, wherein the comparison processing unit outputs the comparison result of the dimensional comparison of the allowable capacity-passing number minimum stop time $T_5$ and the allowable capacity-passing number stop time $T_6$ to the discharge unit retaining/passing number calculation section.

9. The sealed document preparation system according to claim 8, wherein the comparison processing unit outputs an adjustment value calculation instruction for the calculation of the print set gap adjustment value $G_2'$ to the print set gap adjustment value calculation section, when the discharge unit intermittent stop allowable time $T_4$ is less than the discharge unit intermittent stop time $T_3$.

10. The sealed document preparation system according to claim 4, wherein the sealed document preparation condition includes the enclosed document conveying direction length $L_2$, the envelope paper conveying direction length $L_3$, the sealed document conveying direction length $L_4$, and the enclosed document sheet number N, the printing condition includes the paper gap $G_1$, the print set basic gap $G_2$, and the printing unit conveying rate $V_1$, the enclosing/sealing conditions include the discharge unit sealed document minimum allowable gap $G_3$, the enclosing and sealing unit conveying rate $V_2$, and the discharge unit conveying length $L_1$, the attachment maintenance time selection condition is configured as an attachment maintenance time table that associates the activation condition temperature detected by the temperature detection unit with the attachment maintenance time T that is required for the remoistenable adhesive specified for each activation condition temperature, and the integrated control unit drives and controls the discharge unit using the discharge unit conveying rate that is calculated using the activation condition temperature detected by the temperature detection unit, and attachment maintenance time that is selected by reference to the attachment maintenance table stored in the integrated storage unit, and the discharge unit conveying length $L_1$.

11. The sealed document preparation system according to claim 10, wherein the integrated control unit further uses the sealed document preparation condition, the printing condition, and the enclosing/sealing condition to calculate a discharge unit sealed document gap $G_4$ that is a gap between the sealed documents in the discharge unit, and when the discharge unit sealed document gap $G_4$ is less than the discharge unit sealed document minimum allowable gap $G_3$, the print set gap adjustment value $G_2'$ that is the print set gap adjustment value in the printing unit is calculated using the sealed document preparation condition, the printing condition, and the enclosing/sealing condition, and the printing unit is driven and controlled to coincide with the print set gap that is obtained by adding the print set gap adjustment value $G_2'$ to the print set basic gap $G_2$.

12. The sealed document preparation system according to claim 11, wherein the integrated control unit includes:

a discharge rate calculation unit configured to use the attachment maintenance time T corresponding to the activation condition temperature detected by the temperature detection unit and the discharge unit conveying length $L_1$ stored in the integrated storage unit to calculate and output the discharge unit conveying rate $V_3$, an envelope paper pitch calculation section configured to use the enclosed document conveying direction length $L_2$, the envelope paper conveying direction length $L_3$, the enclosed document sheet number N, the paper gap $G_1$, and the print set basic gap $G_2$ that are stored in the integrated storage unit to calculate an envelope paper pitch $P_1$, an sealed document pitch calculation section configured to use the printing unit conveying rate $V_1$ and the enclosing and sealing unit conveying rate $V_2$ stored in the integrated storage unit, and the envelope paper pitch $P_1$ calculated by the envelope paper pitch calculation section to calculate a sealed document pitch $P_2$, a discharge unit sealed document pitch calculation section configured to use the enclosing and sealing unit conveying rate $V_2$ stored in the integrated storage unit, the discharge unit conveying rate $V_3$ calculated by the discharge rate calculation unit, and the sealed document pitch $P_2$ from the sealed document pitch calculation section to calculate a discharge unit sealed document pitch $P_3$, a discharge unit sealed document gap calculation section configured to use the discharge unit sealed document pitch $P_3$ from the discharge unit sealed document pitch calculation section and the sealed document conveying direction length $L_4$ stored in the integrated storage unit to calculate the discharge unit sealed document gap $G_4$, a print set gap adjustment value section configured to use the enclosing and sealing unit conveying rate $V_2$ and the discharge unit sealed document minimum allowable gap $G_3$ stored in the integrated storage unit, the discharge unit conveying rate $V_3$ calculate by the discharge rate calculation unit, and the discharge unit sealed document gap $G_4$ from the discharge unit sealed document gap calculation section to calculate the print set gap adjustment value $G_2'$, a comparison processing unit configured to compare the dimensional relationship between the discharge unit sealed document gap $G_4$ from the discharge unit sealed document gap calculation section and the discharge unit sealed document minimum allowable gap $G_3$ stored in the integrated storage unit, and when the discharge unit sealed document gap $G_4$ is less than the discharge unit sealed document minimum allowable gap $G_3$, output gap adjustment control information to control the print set gap in the printing unit using the print set gap execution value $G_5$ obtained by adding the print set gap adjustment value $G_2'$ from the print set gap adjustment value calculation section to the print set basic gap $G_2$, a discharge control unit configured to drive and control the discharge unit at a conveying rate according to the discharge unit conveying rate $V_3$ calculated by the discharge rate calculation unit, and a printing-side control unit configured to adjust and control the driving of the printing unit to coincide with the print set gap according to the gap adjustment control information from the comparison processing unit.

13. The sealed document preparation system according to claim 12, wherein the comparison processing unit, when the discharge unit sealed document gap $G_4$ is less than the discharge unit sealed document minimum allowable gap $G_3$, is configured to output an adjustment value calculation instruction to calculate the print set gap adjustment value $G_2'$ to the print set gap adjustment value calculation section.

* * * * *